US008372794B2

(12) United States Patent
Beatty

(10) Patent No.: US 8,372,794 B2
(45) Date of Patent: Feb. 12, 2013

(54) EMULSION COMPOSITIONS AND A METHOD FOR SELECTING SURFACTANTS

(75) Inventor: Richard P. Beatty, Newark, DE (US)

(73) Assignee: Invista North America S.A R.L., Wilmington, DE (US)

( * ) Notice: Subject to any disclaimer, the term of this patent is extended or adjusted under 35 U.S.C. 154(b) by 139 days.

(21) Appl. No.: 12/963,943

(22) Filed: Dec. 9, 2010

(65) Prior Publication Data

US 2011/0312870 A1 Dec. 22, 2011

Related U.S. Application Data

(60) Provisional application No. 61/286,627, filed on Dec. 15, 2009, provisional application No. 61/326,072, filed on Apr. 20, 2010.

(51) Int. Cl.
*C11D 7/50* (2006.01)

(52) U.S. Cl. ..... 510/417; 510/365; 510/505; 510/506

(58) Field of Classification Search ..... 510/417, 510/365, 506, 505
See application file for complete search history.

(56) References Cited

U.S. PATENT DOCUMENTS 4,561,991 A * 12/1985 Herbots et al. ..... 510/281
5,158,710 A * 10/1992 VanEenam ..... 510/264
5,171,475 A * 12/1992 Freiesleben ..... 510/417
5,376,298 A * 12/1994 Michael ..... 510/238
5,387,363 A * 2/1995 Distaso ..... 510/207
5,419,848 A * 5/1995 VanEenam ..... 510/365
5,518,661 A * 5/1996 Langford et al. ..... 252/364
5,744,438 A * 4/1998 Distaso ..... 510/207
5,821,209 A * 10/1998 Distaso et al. ..... 510/207
5,851,972 A * 12/1998 Distaso et al. ..... 510/206
5,854,188 A * 12/1998 Distaso et al. ..... 510/206
5,905,066 A * 5/1999 Zocchi et al. ..... 510/280
5,948,743 A * 9/1999 Fonsny et al. ..... 510/280
5,985,814 A * 11/1999 Zocchi et al. ..... 510/280
6,114,298 A * 9/2000 Petri et al. ..... 510/372
6,423,677 B1 * 7/2002 Van Eenam ..... 510/365
6,472,027 B1 * 10/2002 Olson et al. ..... 427/492
6,544,942 B1 * 4/2003 Smith et al. ..... 510/417
6,593,283 B2 * 7/2003 Hei et al. ..... 510/214
6,828,296 B2 * 12/2004 Olson et al. ..... 510/506
6,982,244 B2 * 1/2006 Gross et al. ..... 510/365
7,018,969 B1 * 3/2006 Gross et al. ..... 510/365
7,053,037 B2 * 5/2006 Smith et al. ..... 510/417
7,365,046 B2 * 4/2008 Griese et al. ..... 510/417
7,467,633 B2 * 12/2008 Smith et al. ..... 134/25.2
7,547,670 B2 * 6/2009 Gross et al. ..... 510/197
2003/0148911 A1 * 8/2003 Smith et al. ..... 510/417

* cited by examiner

*Primary Examiner* — Gregory Webb
(74) *Attorney, Agent, or Firm* — Robert B. Furr, Jr.; Susanne H. Goodson

(57) ABSTRACT

A method for preparing a microemulsion is disclosed which employs a method based upon identification of the phase behavior of a plurality of components comprising the microemulsion. Further disclosed is a microemulsion composition comprising a first component, coupling agent, and surfactant.

6 Claims, 1 Drawing Sheet

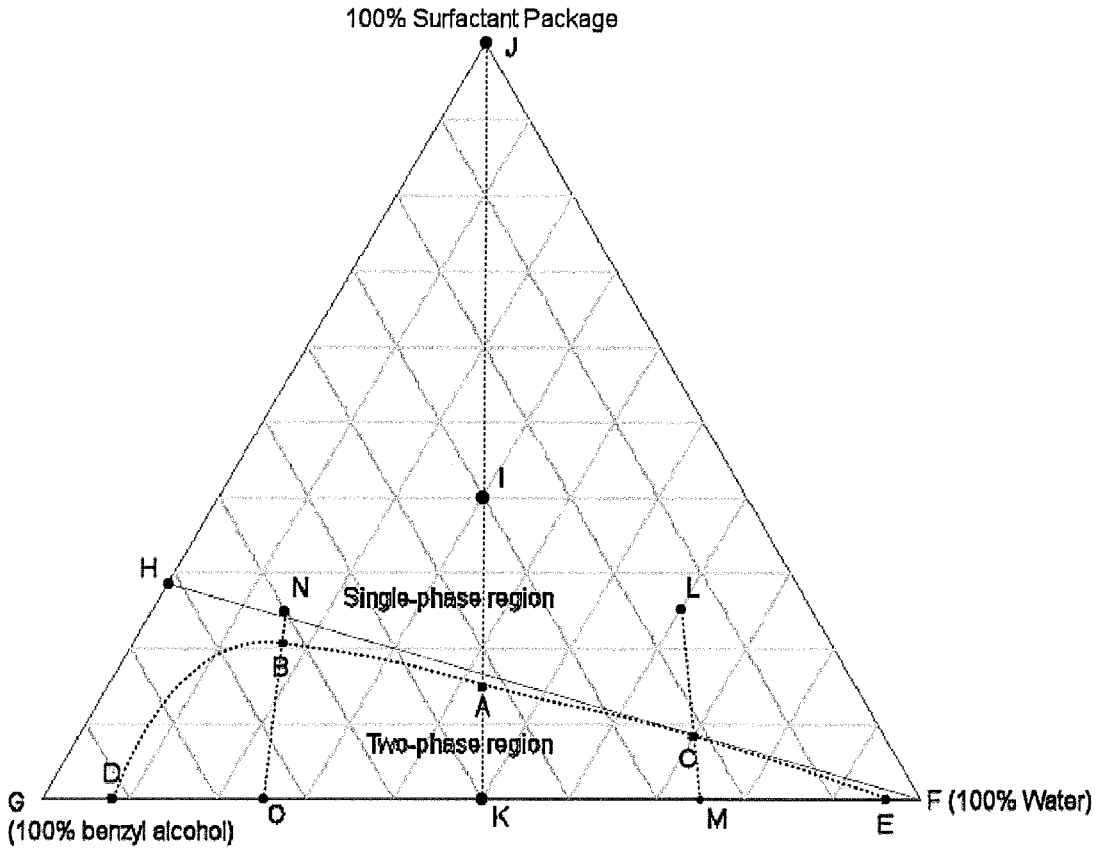
100% Surfactant Package
J
I
H
N
Single-phase region
L
B
A
Two-phase region
C
D
G
(100% benzyl alcohol)
O
K
M
E
F (100% Water)

EMULSION COMPOSITIONS AND A METHOD FOR SELECTING SURFACTANTS

RELATED APPLICATIONS

This application claims benefit to Provisional Application No. 61/286,627 filed Dec. 15, 2009 and Provisional Application No. 61/326,072 filed Apr. 20, 2010, both of which are herein incorporated by reference in their entirety.

FIELD OF THE INVENTION

The disclosures herein relate to emulsions and microemulsions, and to a method for selecting surfactants and coupling agents useful for preparing emulsions and microemulsions. More particularly, the method disclosed employs a method based upon identification of the phase behavior of a plurality of components comprising an emulsion or microemulsion.

BACKGROUND OF THE INVENTION

Microemulsions have attracted interest for use in many applications due to their ability to improve solubility, their phase stability, their increased shelf life compared to macroemulsions, and their ease of preparation, not requiring high-energy mixing techniques.

An emulsion comprises a first phase that is liquid under conditions of use, at least one additional phase that is liquid under conditions of use and immiscible with the first liquid phase, and a surfactant. Each liquid phase may comprise more than one ingredient and other ingredients may optionally be present. One of the liquid phases often comprises water, but this is not a requirement. In addition, a microemulsion may comprise a coupling agent. When properly selected and present in a favorable concentration ratio, these components spontaneously emulsify to form a, thermodynamically stable and visually transparent microemulsion. In contrast, normal emulsions (macroemulsions) typically require energetic mixing to form and are opaque and thermodynamically unstable, separating over time into layers. A properly composed microemulsion concentrate, comprising all ingredients of a microemulsion except for one of the liquid phases, can be added to that one liquid phase and will form a microemulsion with only gentle mixing being required.

Selection and design of microemulsion compositions is complicated, time-consuming, and unpredictable. Although numerous microemulsion systems are known, a surfactant package (surfactant and coupling agent) that is effective for one pair of immiscible liquids will not necessarily be effective for a different pair of immiscible liquids.

SUMMARY OF THE INVENTION

There remains in the art an unmet need for a simplified method to make microemulsions. The disclosures herein enable a method for selecting ingredients for microemulsions and a systematic method for optimizing composition to obtain microemulsion concentrates and stable microemulsions. The microemulsions disclosed herein may be useful for a variety of purposes or end-use applications. These include a wide variety of household, institutional, and industrial cleaning tasks, such as removal of paint, grease, ink, graffiti, oil, adhesive, various resins, soap scum and shower residues, and other soils from hard and soft substrates. Further, the microemulsions disclosed herein are fluid at room temperature (e.g., 25° C.).

In an embodiment, the disclosures herein provide a method for preparing a microemulsion in a manner following.

A method for selecting component concentrations for a microemulsion based upon identification of the phase behavior of a plurality of components comprising the microemulsion, the method comprising:

i. constructing a three-component phase diagram by ii. preparing a mixture having an initial composition according to the steps of;

iii. providing a first liquid phase component, iv. providing a second liquid phase component immiscible with the first liquid phase component, and v. providing a third component comprising a surfactant package, and wherein first, second and third components are present in equal amounts by weight in the mixture;

vi. representing the initial composition of the mixture at a center point of the three-component diagram wherein the vertices of the three component diagram represent pure first component, pure second component and pure third component, and vii. adding incrementally to this mixture a quantity of the first component and a quantity of the second component in equal amount by weight fraction, and wherein each addition of the incremental quantity of the first component and the second component varies the composition of the mixture along a line bisecting the three-component phase diagram toward a side opposite to and passing through a vertex of the three-component phase diagram representing pure surfactant package;

viii. observing after each incremental addition of first and second components, an indication of clarity or turbidity in the mixture and ix. noting the weight fraction of first and second components in the composition corresponding to an initial indication of turbidity, the initial indication of turbidity marking a transition of the mixture from a microemulsion to two-phase separation; and x. preparing a second mixture having a second initial composition according to the steps of;

xi. providing a first liquid phase component, xii. providing a second liquid phase component immiscible in the first liquid phase component, and xiii. providing a third component comprising a surfactant package, and wherein the first, second and third components are present in known weight fractions, the known weight fractions being different from the weight fractions of the first mixture from steps i through ix;

xiv. adding incrementally to the second mixture a quantity of the first component and a quantity of the second component in a fixed ratio of weight fractions, and wherein each addition of an incremental quantity of the first component and the second component advances the composition along a fixed ratio composition line of the three-component phase diagram toward a side opposite to the vertex of the three-component phase diagram representing pure surfactant package;

xv. observing after each addition of first and second components, an indication of clarity or turbidity in the mixture and xvi. noting the amount of first and second components corresponding to an initial indication of turbidity, the initial indication of turbidity marking a transition of the mixture from a microemulsion to two-phase separation; and xvii. repeating Step x by preparing at least a third mixture having a third initial composition and xviii. repeating steps xi and through xvi, and optionally, xix. iterating steps x through xvi, and xx. identifying a locus of points for compositions on the three-component phase diagram which mark a transition of the mixture composition from a microemulsion region to two-phase region.

In a further embodiment, the disclosures herein include:

i. A method for providing a microemulsion composition comprising a first liquid phase component, a second liquid phase component, and a third component comprising a surfactant package, and wherein first, second and third components are selected in an amount by weight from the single-phase region indentified from the three-component phase diagram of the above method for selecting component concentrations for a microemulsion.

ii. A method for providing a microemulsion concentrate comprising either the first liquid phase component or the second liquid phase component but not both and a surfactant package, wherein the relative proportions of liquid phase component and surfactant package are the same as determined in step i.

In a further embodiment, the disclosures herein include a method for preparing a microemulsion by diluting a microemulsion concentrate of step ii with a second liquid phase immiscible with the first liquid phase.

In a further embodiment, the disclosures herein include a composition comprising (a) a first liquid phase composition selected from the group consisting of water, alcohols, glycols, glycol ethers, hydrocarbons, alkylene carbonates, and esters, or combinations of two or more thereof; (b) a coupling agent selected from the group consisting of one or more aliphatic alcohols, aliphatic glycols, glycol ethers, N-alkyl pyrollidones, dialkyl sulfoxides, triethyl phosphate, and acetone; and (c) an anionic surfactant selected from the group consisting of one or more sulfonates, sulfates, ethoxylated sulfates, sulfosuccinates, or combinations thereof. In a further embodiment, the composition is an emulsion and further comprises (d) a second liquid phase, wherein the second liquid phase is different from the first liquid phase and is immiscible in the first liquid phase, and wherein the second liquid phase is selected from the group consisting of water, alcohols, glycols, glycol ethers, hydrocarbons, alkylene carbonates, and esters, or combinations of two or more thereof.

In an embodiment, the emulsion composition is a microemulsion.

In a further embodiment, the disclosures herein include a composition of matter comprising benzyl alcohol, DOSS and NPG that forms a stable microemulsion when diluted with up to but less than 100 weight percent water. "DOSS" is di-2-ethylhexyl sodium sulfosuccinate, also referred to as "dioctyl" sodium sulfosuccinate. In another embodiment, the composition may contain 0.1 to 15 weight percent water, including, for example 0.1 to 10 and 0.1 to 5 weight percent water.

In a further embodiment, the disclosures herein include a composition comprising benzyl alcohol, DOSS, NPG, and water that does not appear to the naked eye to scatter non-directional light. In another embodiment, the composition may containing from 10 to 90 weight percent water and not appear to the naked eye to scatter non-directional light.

In a further embodiment, the disclosures herein include a composition comprising benzyl alcohol, DOSS, NPG, and water that is a microemulsion.

In a further embodiment, the disclosures herein include a composition comprising benzyl alcohol, DOSS, NPG, and water that does not appear to the naked eye to scatter non-directional light but appears to the naked eye to scatter a collimated light beam when viewed at an angle with respect to the collimated light beam. In a further embodiment, the viewing angle is from about 20 degrees to about 160 degrees with respect to the collimated light beam.

In a further embodiment, the disclosures herein provide microemulsion compositions comprising a first liquid phase component, a second liquid phase component, and a third component comprising a surfactant package wherein the relative amounts of each component are selected from the single-phase region identified according to the method described above.

In a further embodiment, the disclosures herein provide microemulsions wherein one liquid phase comprises benzyl alcohol.

In a further embodiment, the disclosures herein provide microemulsion concentrate compositions comprising either the first liquid phase component or the second liquid phase component, but not both, and a surfactant package, wherein the relative proportions of liquid phase component and surfactant package are determined according to the method described above.

In a further embodiment, the disclosures herein provide a microemulsion concentrate wherein the liquid phase comprises benzyl alcohol.

In a further embodiment, the disclosures herein provide a method for providing a microemulsion concentrate composition according to the foregoing method disclosure for preparing a microemulsion and comprising, identifying a first liquid phase component and a surfactant package; selected in an amount by weight from the single-phase region identified from the three-component phase diagram.

In a further embodiment, the disclosures herein provide a method for providing a microemulsion concentrate composition according to the foregoing method disclosure for preparing a microemulsion and comprising, identifying a first liquid phase component comprising benzyl alcohol and a second component comprising a surfactant package; selected in an amount by weight from the single-phase region indentified from the three-component phase diagram.

In a further embodiment, the disclosures herein provide a method for selecting surfactants to make microemulsion concentrates and microemulsions.

In a further embodiment, the disclosures herein provide a method for selecting surfactants to make microemulsion concentrates and microemulsions comprising benzyl alcohol.

In a further embodiment, the disclosures herein provide compositions comprising surfactant packages selected by this method.

In a further embodiment, the disclosures herein provide compositions comprising surfactant packages having advantageous structural features.

In some embodiments, a microemulsion concentrate is provided that can be diluted with water to form a microemulsion, using 1 part water for every 2 parts microemulsion concentrate.

In some embodiments a microemulsion concentrate is provided that can be diluted with water to form a microemulsion, using 1 part water for every 1 part microemulsion concentrate.

In some embodiments a microemulsion concentrate is provided that can be diluted with water to form a microemulsion, using more than 1 part water to every 1 part microemulsion concentrate, up to being infinitely dilutable with water.

In some embodiments, a microemulsion concentrate is provided that is stable over a wide range of temperatures normally encountered in storage, shipment, and handling, such as from about −10° C. to +60° C.

In some embodiments, the present disclosure provides microemulsion compositions comprising a liquid phase that is not considered flammable.

In some embodiments, the present disclosure provides microemulsion compositions comprising a liquid phase that is not considered combustible.

In some embodiments, the present disclosure provides microemulsion compositions comprising a liquid phase that is not considered a volatile organic compound (VOC) or that has favorable treatment under VOC regulations.

In some embodiments, the present disclosure provides microemulsion compositions comprising a liquid phase with vapor pressure less than 0.1 mm Hg absolute (0.013 kPa absolute) at 20° C.

In some embodiments, the present disclosure provides microemulsion compositions comprising a liquid phase with vapor pressure less than 0.075 mm Hg absolute (0.01 kPa absolute) at 20° C.

In some embodiments, the present disclosure provides microemulsion compositions comprising a liquid phase with an atmospheric boiling point greater than 250° C.

In some embodiments, the present disclosure provides microemulsion compositions comprising a co-solvent.

In a further embodiment, the disclosures herein provide compositions comprising ingredients selected from the group consisting of any of benzyl alcohol, DOSS and neopentyl glycol.

In a further embodiment, the disclosures herein provide microemulsions for use in spray, dip, brush, and wipe applications.

In a further embodiment, the disclosures herein provide articles comprising microemulsion- or microemulsion concentrate-presaturated wipes for use in applying the microemulsion or microemulsion concentrate.

In a further embodiment, the disclosures herein provide uses for microemulsions or microemulsion concentrates in cleaning applications (e.g., paint removal, oil and grease spot removal, graffiti remediation, adhesive removal, hard and soft surface cleaning, spot treatments of surfaces and fabric, hand cleaners, finger and toe nail polish removal, etc.).

BRIEF DESCRIPTION OF THE FIGURES

FIG. 1 is a representation of a three-component phase diagram where component 1 is benzyl alcohol, component 2 is water, and component 3 is a surfactant package.

DETAILED DESCRIPTION

Unless defined otherwise, all technical and scientific terms used herein have the same meaning as commonly understood by one of ordinary skill in the art to which this disclosure belongs. Embodiments of the present disclosure employ, unless otherwise indicated, techniques of chemistry, and the like, which are within the skill of the art. Such techniques are explained fully in the literature.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

Although the following detailed description contains many specifics for the purpose of illustration, a person of ordinary skill in the art will appreciate that many variations and alterations to the following details are within the scope of the herein disclosed embodiments.

As will be apparent to those of skill in the art upon reading this disclosure, each of the individual embodiments described and illustrated herein has discrete components and features that may be readily separated from or combined with the features of any of the other several embodiments without departing from the scope or spirit of the present disclosure. Any recited method can be carried out in the order of events recited or in any other order that is logically possible.

It is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting.

Although any methods and materials similar or equivalent to those described herein can also be used in the practice or testing of the present disclosure, the preferred methods and materials are now described. It is also possible in the present disclosure that steps can be executed in different sequence where this is logically possible.

Accordingly, the following embodiments are set forth without any loss of generality to, and without imposing limitations upon any claimed invention. It is to be understood that this disclosure is not limited to particular embodiments described, as such may vary. It is also to be understood that the terminology used herein is for the purpose of describing particular embodiments only, and is not intended to be limiting, since the scope of the present disclosure will be limited only by the appended claims.

A microemulsion comprises a first liquid phase component, a second liquid phase component, and a third component comprising a surfactant package. A microemulsion concentrate comprises either the first liquid phase component or the second liquid phase component but not both and a surfactant package.

Candidates for a first liquid phase and second liquid phase may be selected based on efficacy for a particular end use. For example, candidates for a degreasing application would be selected from the group of liquid phases that have good efficacy for grease removal while candidates for a paint stripping application would be selected from the group of liquid phases that have efficacy for paint removal. Blends of solvents may be used to adjust performance for particular situations, such as to remove graffiti ink from a painted substrate without removing the underlying paint.

The Hansen Solubility Parameter (HSP) approach provides a useful framework for selection of effective solvents and solvent blends for dissolving various solutes (e.g., soils or resins). This approach involves first determining the Hansen Solubility Envelope of at least one solute in terms of HSP, then designing a solvent system (single solvent or mixture of solvents) with HSP within the solubility envelope to dissolve the solute. In systems comprising more than one solute with different Hansen Solubility Envelopes, it may be desirable and possible to design a solvent system that will selectively dissolve one or more of the solutes but not all of the solutes, thus providing a solvent system that may be useful for separation of the solute mixture. When a range of solutes must be dissolved, or the particular requirements of the solute are unknown, the HSP approach provides a systematic way to prepare solvent blends so that a limited number of blends can cover a wide range of HSP space.

Various criteria other than efficacy may be applied to narrow the field of candidates and select preferred candidates. For example, it may be desirable to select or deselect candidates based on cost, environmental, health, or safety criteria. Regulatory criteria are often decisively important, even to the extent of forcing de-selection of incumbent materials and reformulation using alternative materials. Warning labels are often dictated by regulation or by manufacturer classification and can influence consumer choice and success of a product in the marketplace. Other criteria such as the amount of renewable or recycled content may be specified by regulation or may influence consumer choice. Specific criteria that may be considered include, for example, flash point or other flammability criteria, boiling point, vapor pressure, photochemical reactivity, explosivity, corrosivity, biodegradability, whether a material is persistent in the environment, bioaccumulative, or toxic to man or various other organisms, and whether any specific regulations restrict use or handling. Knowledge of these myriad criteria constitutes a competitive advantage in the marketplace for the formulator who can proactively develop formulations in anticipation of market needs.

In some embodiments, the present disclosure provides microemulsion compositions comprising a liquid phase that is not considered flammable according to government regulations. The specific criteria for non-flammability vary somewhat in different countries, but are usually based on flash point. For example, in the United States, liquids with flash point below 60° C. are considered flammable according to CFR49.173.120.

In some embodiments, the present disclosure provides microemulsion compositions comprising a liquid phase that is not considered combustible according to government regulations. The specific criteria for non-combustibility vary somewhat in different countries, but are usually based on flash point. For example, in the United States, liquids with flash point above 93° C. are not considered combustible according to CFR49.173.120.

In some embodiments, the present disclosure provides microemulsion compositions comprising a liquid phase that is not considered a volatile organic compound (VOC) or that has favorable treatment under VOC regulations. Distinctions are often made based on vapor pressure and/or boiling point. Other regulations and criteria exist.

In some embodiments, the present disclosure provides microemulsion compositions comprising a liquid phase with vapor pressure less than 0.1 mm Hg absolute (0.013 kPa absolute) at 20° C.

In some embodiments, the present disclosure provides microemulsion compositions comprising a liquid phase with vapor pressure less than 0.01 kPa absolute (0.075 mm Hg absolute) at 20° C.

In some embodiments, the present disclosure provides microemulsion compositions comprising a liquid phase with boiling point greater than 250° C.

In some embodiments, the present disclosure provides microemulsion compositions comprising a liquid phase that is considered biodegradable. Biodegradable means that a substance meets specific criteria for biodegradability including criteria to be considered "readily biodegradable" according to method OECD 301D.

Examples of components meeting one or more of the above mentioned criteria can be found in a wide variety of chemical classes, including: water, alcohols (e.g., benzyl alcohol, methylbenzyl alcohol, 2-ethylhexanol), glycols (e.g., diethylene glycol, dipropylene glycol, triethylene glycol, neopentyl glycol, glycerol), glycol ethers (e.g., diethylene glycol butyl ether, dipropylene glycol butyl ether, triethylene glycol ethyl ether, triethylene glycol methyl ether, triethylene glycol butyl ether, tripropylene glycol methyl ether), hydrocarbons (e.g., ISOPAR® M, Exxsol® D110), alkylene carbonates (e.g., ethylene carbonate, propylene carbonate, butylene carbonate), and esters (e.g., methyl acetate, dimethyl succinate, dimethyl adipate, dimethyl glutarate, methyl soyate, triethyl citrate, tributyl citrate, glycerol acetate).

In general, both liquid phases may be selected from the preceding list provided that the two selected phases are immiscible with each other. Often, one liquid phase is water, but this is not necessarily the case. For example a hydrocarbon liquid phase may be paired with an immiscible organic liquid phase such as dimethyl succinate or dimethyl adipate.

A surfactant package comprises at least one surfactant and optionally a coupling agent. The role of the surfactant package is to stabilize the emulsion or microemulsion. The surfactant package may also have a role in efficacy of the formulated emulsion or microemulsion for a particular application.

Surfactants may be selected from any of the general classes of surfactants including anionic, cationic, nonionic, amophoteric, zwitterionic, polymeric, silicone, and fluoro-surfactants. As with liquid phases, surfactants may be selected or deselected based on criteria other than efficacy in stabilizing the emulsion or for a given application. The same selection criteria that may be used for liquid phases may also be applied for surfactants, for example, flammability, biodegradability, and environmental (especially aquatic) toxicity. Some governmental and non-governmental agencies have begun to establish programs to screen surfactants and other ingredients against these and other criteria (e.g., the United States Environmental Protection Agency and the Design for the Environment program).

It may be desirable to use surfactants that have low concentration of impurities, particularly inorganic salts. For example, the presence of inorganic salts (e.g., sodium chloride, sodium sulfate) may reduce the stability of microemulsions. For example, the presence of 0.6 wt % sodium sulfate in DOSS (dioctyl sodium sulfosuccinate) is observed to result in cloudiness and phase separation in a mixture that would otherwise be a visibly clear, stable aqueous microemulsion. Although undesirable when preparing stable microemulsions, controlled addition of an inorganic salt may be useful for intentionally "breaking" a microemulsion of the present disclosure, that is, for changing a microemulsion into a macroemulsion or multiple liquid-phase mixture from which individual constituents can be recovered by separation techniques known in the art. Breaking a microemulsion and separating the aqueous and organic phases may allow for optimized waste treatment. For example, an aqueous microemulsion is used to remove cutting oil from machined metal parts; the used microemulsion (containing removed cutting oil) is treated with sodium chloride to break the microemulsion and after phase separation the aqueous and organic portions are treated separately, by biotreatment and incineration respectively. Breaking the microemulsion reduces the organic load on the biotreatment facility while allowing the organics to be treated by a more appropriate method of incineration, which would not have been as practical for the entire aqueous microemulsion.

Solid, nearly 100% pure, DOSS is commercially available (e.g., Aerosol® OT-100 available from Cytec Industries, Inc., Surfactants and Specialty Monomers, West Paterson, N.J., USA), but its cost is prohibitively high for some applications and the waxy material is difficult to handle on large scale.

DOSS in solution form is less expensive and more easily handled on large scale. DOSS solutions are most commonly commercially available as 70 or 75 wt % solutions in mixtures of water and ethanol. Solutions in a few other solvents are also commercially available (e.g., propylene glycol, diethylene glycol, petroleum distillate). However, in cases where an anhydrous concentrate is being prepared, it is undesirable to introduce water. Further, the common commercially available solvents may be unacceptable due to physical characteristics (vapor pressure, flash point, etc.), toxicity concerns, or they may be incompatible with other essential components of a composition.

In cases where all solvents and other ingredients in the microemulsions and microemulsion concentrates are vetted for their safety and health profiles, the solvent used for DOSS must also be considered. Additionally, it may be desirable to select the solvent for DOSS solutions from among the solvents to be contained in the microemulsions and microemulsion concentrate. Accordingly, it has been found that certain solvents are useful solvents for DOSS and afford easily-handled solutions containing >50 wt % concentration of DOSS. Non-limiting examples include DBE® ester and FlexiSolv™ benzyl alcohol, both available from INVISTA S.à.r.l., Wilmington, Del., USA.

Solutions of DOSS in alternative solvent can be prepared by adding 100% DOSS to the desired alternative solvent and agitating until all DOSS has dissolved, but this does not overcome the economic disadvantage and handling difficulty of 100 wt % DOSS. More economically, solutions of DOSS in alternative solvent can be prepared by adding the desired alternative solvent at a point in the DOSS manufacturing process where water and ethanol (or other solvent) would normally be used to dissolve DOSS. Methods known in the art, such as heat, vacuum, and inert-gas stripping can be used to reduce water (and ethanol, if present) in the DOSS to any desired level, either before or after addition of alternative solvent. Alternatively, solutions of DOSS in alternative solvent can be prepared by treating a commercially available DOSS solution in water/ethanol with alternative higher-boiling solvent and then using the same known methods of heat, vacuum, and inert-gas stripping to remove water/ethanol, producing a solution of DOSS in alternative solvent.

Selection of a surfactant depends on the nature of the two immiscible liquid phases and their relative proportions in the fully-formulated emulsion or microemulsion. A surfactant effective for emulsifying one particular first liquid phase in a particular second immiscible liquid phase may not be effective for emulsifying the same first liquid phase in a different second liquid phase. A surfactant effective for emulsifying a small amount of an oil phase in a large amount of water (oil-in-water emulsion) may not be effective for emulsifying a small amount of water in a large amount of oil (water-in-oil emulsion). A surfactant effective over one range of liquid phase proportions may have poor solubility over a different range of liquid phase proportions, making it ineffective.

Cases where it is desirable that a microemulsion concentrate form a clear, transparent, stable microemulsion over a very wide range of dilutions (with an immiscible second liquid phase) are especially difficult to formulate because of the above-mentioned conflicting requirements. For example, as a microemulsion concentrate is progressively diluted with water the characteristics and surfactant requirements of the emulsion may change. At low dilutions, where a lesser amount of water is added to a greater amount of microemulsion concentrate, the oil phase may be continuous, resulting in a water-in-oil microemulsion. Such emulsions typically employ surfactants that are relatively more soluble in the oil phase. At high dilutions, where a lesser amount of microemulsion concentrate is added to a greater amount of water, the aqueous phase may be continuous, resulting in an oil-in-water microemulsion. Oil-in-water emulsions typically employ surfactants that are relatively more soluble in the water phase. Surfactants that are effective near one end of the water-dilution continuum may not be effective at the other end or may not even be soluble at the other end.

Some microemulsion concentrates of the present disclosure are infinitely dilutable, that is they can be diluted with any amount of water and remain clear and visually homogeneous. Other microemulsion concentrates of the present disclosure have a more limited range where dilution with water produces microemulsions. Outside of the dilution range where stable microemulsions are formed, macroemulsions may be formed. Unlike microemulsions, macroemulsions are not thermodynamically stable and will separate over time. The stability time of a macroemulsion (length of time before unacceptable phase separation occurs) may vary from minutes to months or even years and the amount of phase separation considered acceptable will vary with intended use. Although not ideal, formation of macroemulsions is acceptable as long as stability of the macroemulsion is sufficient for the intended use. With other dilutions outside the range where stable microemulsions are formed, particularly with very low or high dilutions, when the organic phase and water are not totally, mutually insoluble, clear, visually-homogeneous solutions may be formed. For example, at very low dilutions (large amount of microemulsion concentrate and relatively small amount of water), water may be soluble in the organic phase. At very high dilutions, the organic phase may be soluble in water.

In some embodiments, the surfactant comprises an anionic surfactant.

In some embodiments, the surfactant comprises an anionic sulfonate surfactant, i.e., a sulfonic acid that has been at least partially neutralized, for example using alkali metal hydroxide, ammonia or an amine (e.g., sodium dodecylbenzene sulfonate, sodium p-toluene sulfonate, sodium xylene sulfonate, sodium lignin sulfonate, etc.).

In some embodiments the surfactant comprises an anionic sulfate surfactant, i.e., a sulfuric acid monoester that has been at least partially neutralized, for example using alkali metal hydroxide, ammonia or an amine (e.g., sodium octyl sulfate, sodium 2-ethylhexyl sulfate, sodium lauryl sulfate, etc).

In some embodiments the surfactant comprises an anionic ethoxylated sulfate surfactant, i.e., a sulfuric acid monoester of an ethoxylated fatty alcohol that has been at least partially neutralized, for example using alkali metal hydroxide, ammonia or an amine (e.g., sodium laureth sulfate, sodium pareth sulfate, etc).

In some embodiments the surfactant comprises an anionic sulfosuccinate (e.g., dioctyl sodium sulfosuccinate, dicyclohexyl sodium sulfosuccinate, etc.).

In some embodiments, the surfactant comprises a surfactant that is not flammable, not combustible, that is readily biodegradable, and/or that has low aquatic toxicity.

The role of the coupling agent is to work in synergy with the surfactant to stabilize the emulsion or microemulsion over a range of compositions. Without being bound by any theory, it has been found that the best coupling agents are those materials that are soluble in both liquid phases and can serve as effective homogenizing solvents for the two liquid phases in the absence of surfactant. Coupling agent may be further selected according to the same efficacy and ancillary criteria listed for liquid phases and surfactants. Surfactants are commonly more expensive than the liquid phase components of an emulsion formulation. Consequently, it may be desirable to select the components of the surfactant package (i.e., surfactants and coupling agents) so that effective emulsions can be obtained with a minimum amount of surfactant package. It is further desirable to select the components of the surfactant package to enable emulsion stability over the desired range of dilution. It is possible that components of a surfactant package may act synergistically or antagonistically. Consequently, the surfactant package must be optimized experimentally, considering not only selection of the individual components but also their relative proportions.

The methods of the current disclosure provide a method that can be used to facilitate experimental optimization of surfactant package. It is not necessary to develop an entire phase diagram for each possible combination of components and proportions. Rapid preliminary screening can be accomplished by comparison of the performance of different surfactant packages at one of more of points A, B, and C in FIG. 1. Based on preliminary screening results, the most promising surfactant package compositions can be explored in greater detail.

In an embodiment, the two liquid phases are benzyl alcohol and water. Effective coupling agents for this embodiment include lower aliphatic alcohols up to about $C_6$ (e.g., methanol, ethanol, isopropanol, n-butanol, n-hexanol, etc), aliphatic glycols (e.g., propylene glycol, dipropylene glycol, neopentyl glycol, diethylene glycol, 2-methyl-1,3-propanediol, 1,2-butanediol, 1,2-pentanediol, 1,2-hexanediol, glycerine, etc), glycol ethers (e.g., propylene glycol methyl ether, triethylene glycol methyl ether, triethylene glycol ethyl ether, etc.), N-alkyl pyrollidones (e.g., N-methyl pyrollidone (NMP)), dialkyl sulfoxides (e.g., dimethyl sulfoxide (DMSO)), triethyl phosphate, and acetone.

Other ingredients may be included in emulsions of the present disclosure to provide desired properties or characteristics. Examples of such other ingredients include, but are not limited to, co-solvents, thickening agents or rheology modifiers (e.g., clay, silica, acrylate polymers, cellulosic ethers, gums and resins, etc.), fragrance, coloring agents, activators or pH modifiers (e.g., acids, bases, amines, buffering compositions, etc.), whitening or bleaching agents (including peracids, peroxides, etc.), humectants, emollients, anti-corrosion agents, anti-foam agents, preservatives, chelating agents, etc.

Co-solvents may be included from the beginning as part of either liquid phase component of an emulsion or concentrate, or may be added to a partly- or fully-formulated emulsion or concentrate. Co-solvents may be used to alter the solubility properties of an emulsion or concentrate. In this way, a base emulsion or concentrate formulation may be customized or modified to improve performance in particular end-use applications. Emulsion or concentrate formulations robust enough to allow such modification are particularly useful and versatile because they can be tailored for a variety of end-use applications without needing to go through the time-consuming process of developing a completely new emulsion or concentrate. The Hansen Solubility Parameter system described herein may be used to select co-solvents for a particular end-use application. Co-solvents may be selected according to the same selection criteria used for liquid phase components, described herein.

A microemulsion concentrate is a compact composition that can be diluted at later time or different location with the omitted component to form a microemulsion. From a practical and commercial point of view, it may be less costly and more environmentally responsible to package and ship a smaller volume of microemulsion concentrate rather than a larger volume of fully-formulated microemulsion. The smaller volume requires less packaging material, less storage space, and less energy to transport.

Storage, shipment and handling present additional challenges in that some microemulsion concentrate formulations may become physically or chemically unstable at low or high temperatures. For example, exposure to low temperature may cause freezing or partial crystallization of one or more microemulsion ingredients. Although this phenomenon may be completely reversible, it may be inconvenient to warm the microemulsion concentrate, and melting or re-dissolution may take a long time. If the microemulsion concentrate is not completely homogenized and re-dissolved before use, performance may be affected.

Herein a benzyl alcohol containing microemulsion composition is prepared for illustrative purposes. In particular the phase behavior of a microemulsion is illustrated. The microemulsion is prepared using a surfactant package of dioctyl sodium sulfosuccinate (DOSS) and neopentyl glycol (NPG) present in a weight ratio 2.5 DOSS/1.0 NPG A simplification for visualization of a four-component mixture, is to treat two of the components as a pseudo-component of a three-component mixture. Such a treatment allows a graphical visualization on conventional three-component phase diagrams. In the case of benzyl alcohol-water microemulsions comprising benzyl alcohol, water, DOSS, and NPG, a pseudo-three-component phase diagram is constructed where the three components are benzyl alcohol, water, and surfactant package. Here, surfactant package is a pseudo-component, i.e., a mixture of DOSS and NPG with a specific, constant DOSS/NPG ratio. FIG. 1 is a representation of such a three-component phase diagram where component 1 is benzyl alcohol, component 2 is water, and component 3 is surfactant package.

A process to construct a phase diagram for the DOSS/NPG surfactant, is to mix 1.20 g DOSS, 0.48 g NPG, 1.67 g benzyl alcohol, and 1.67 g water. The ratio of DOSS/NPG ("surfactant package" pseudo-component) in this mixture is ca. 2.5 and the mixture is visually clear and is a microemulsion. The mixture contains equal amounts of water, surfactant package, and benzyl alcohol. This mixture provides a composition plotted at the center of the three-component phase diagram, at a point labeled I in FIG. 1.

To this mixture a small amount of benzyl alcohol is added, followed by an equal amount of water, recording the weight of each addition. Since water and benzyl alcohol are added in equal amounts, each addition moves the composition along a line bisecting the three-component phase diagram and passing through the corner representing 100% surfactant (line J-K in FIG. 1). Each addition moves the composition closer to the side of the triangle opposite the "surfactant package" corner (the point labeled K). After each addition, a visual observation is made. The mixture either remains clear, shows visible turbidity, or a visual sign of phase separation. The first indication of turbidity or phase separation marks the transition from the microemulsion regime. Generally this transition is to a regular emulsion, but sometimes miniemulsions are observed. Accordingly, a point along a phase boundary can be located by this process.

In this process to locate a phase boundary for the composition, the weight of each addition and composition of the mixture resulting after each addition is shown in Table 2 (Example 8). The "amounts added" represent each incremental addition, not a cumulative total, but "weight fraction" represents a cumulative effect of the additions on the initial composition. The composition defining the phase boundary is taken as the average of the last observed clear (microemulsion) composition and the first observed turbid or milky (macroemulsion) composition. Any slight cloudiness or haziness (as shown in Table 2, Example 8) indicates that the composition is very close to a phase boundary. In such a case the previous clear point and the next distinctly milky point are averaged. This point is plotted in FIG. 1, indicated as point A.

A second mixture is prepared with approximately the same DOSS/NPG ratio, but with a higher ratio of benzyl alcohol to water, containing 0.89 g DOSS, 0.37 g NPG, 3.00 g benzyl alcohol, and 0.76 g water. The relative proportions of benzyl alcohol and water place this mixture in a benzyl alcohol rich region of the phase diagram where W/O emulsions might be anticipated. The mixture is visually clear and a microemulsion. Small amounts of benzyl alcohol and water are added, in the proportion of 3 parts benzyl alcohol for every 1 part of water. In this case, the initial composition is labeled as point N in FIG. 1. Each addition moves the composition of the mixture closer to the side of the triangle opposite the "surfactant package" corner, toward a mixture comprising 25 wt % water and 75 wt % benzyl alcohol; labeled as point O in FIG. 1.

Visual observations are made after each addition of water and benzyl alcohol, as described above. Again, the composition defining the phase boundary is taken as the average of the last observed clear (microemulsion) composition and the first observed turbid (macroemulsion) composition. This data is tabulated in Table 3 (Example 8) and the resulting composition is indicated at point B in FIG. 1.

A third mixture is prepared with approximately the same DOSS/NPG ratio, but this time containing 0.89 g DOSS, 0.37 g NPG, 0.76 g benzyl alcohol, and 3.04 g water. The relative proportions of benzyl alcohol and water place this mixture in a water-rich region of the phase diagram where O/W emulsions might be anticipated. The mixture is visually clear and a microemulsion. Small amounts of benzyl alcohol and water are added, in the proportion of 1 part benzyl alcohol for every 3 parts of water. In this case, the initial mixture is shown as point L in FIG. 1. Each subsequent addition moves the composition of the mixture closer to the side of the triangle opposite the "surfactant package" corner, toward a mixture comprising 75 wt % water and 25 wt % benzyl alcohol (point M). Visual observations are made after each addition of water and benzyl alcohol, as before and described above. Again, the composition defining the phase boundary is taken as the average of the last observed clear (microemulsion) composition and the first observed turbid (macroemulsion) composition. Data is tabulated in Table 4 (Example 8) and the resulting composition plotted as point C in FIG. 1.

In FIG. 1, the points D and E represent the solubility of water in benzyl alcohol and of benzyl alcohol in water respectively, with no surfactant package present. The locus of points, meaning a curve drawn through points D-B-A-C-E, identifies the approximate phase boundary between the single-phase (microemulsion) region and the two-phase (macroemulsion) region. Points I, L, and N are all specific microemulsion compositions. A line drawn from point F (100% water) tangent to this curve (approximated by line F-C) and extended to the opposite side of the three component phase diagram (line F-H in FIG. 1.) gives point H.

The composition indicated by point H, at about 28 wt % surfactant and 72 wt % benzyl alcohol, herein, represents the minimum amount of surfactant package needed in a water-free "microemulsion concentrate" of benzyl alcohol and surfactant package. Such a concentrate can be diluted with water with little or no phase separation. Concentrates having this composition are useful in articles of commerce which can be diluted with an appropriate amount of water to form a stable microemulsion. Greater amounts of surfactant package may be employed, up to economic or solubility limits.

The present disclosure may be used by a variety of methods known in the art, including spraying, brushing, wiping, soaking, dip tanks, etc. Pre-saturated wipes may be prepared by applying compositions of the present disclosure to woven or nonwoven substrates. After application, cleaning compositions of the present disclosure may be removed, along with removed soil, by various methods known in the art including wiping, rinsing, scraping and the like. For example, a paint stripper may be applied by spraying onto a surface, and after the paint has been loosened the paint and paint stripper may be removed by pressure washing with water. Many other variations are possible and will be clear to those skilled in the art.

DEFINITIONS

As used herein, for both the specification and the appended claims, the singular forms "a," "an," and "the" include plural referents unless the context clearly dictates otherwise. Thus, for example, reference to "a surfactant" includes a plurality of surfactants. In this specification and in the claims that follow, reference will be made to a number of terms that shall be defined to have the following meanings unless a contrary intention is apparent.

"Concentrate", as used herein, refers to a composition comprising a first liquid phase and a surfactant package that when added to a second liquid phase, immiscible with the first liquid phase, forms an emulsion.

"Coupling agent", as used herein, refers to an organic solvent that, when combined with a surfactant, improves the stability of an emulsion.

"Emulsion", as used herein, refers a stabilized dispersion of one liquid phase in another liquid phase with which it is immiscible. Emulsions are stabilized using surfactants. Often, one liquid phase is water and the other an organic solvent, commonly referred to as the "oil" phase. Different types of emulsions are known depending on which liquid is the continuous phase and which is the dispersed phase, including oil-in-water (O/W, where droplets of oil are dispersed in a water continuous phase), water-in-oil (W/O, where droplets of water are dispersed in an oil continuous phase) and even bicontinuous. It is also possible to form an emulsion of one organic solvent in another organic solvent with which it is immiscible, in which case the "water" and "oil" terminology can still be used to designate the two immiscible liquid phases and to distinguish O/W from W/O emulsions. The term "emulsion" encompasses macroemulsions, miniemulsions, and microemulsions.

"Macroemulsion", as used herein, is an emulsion that is kinetically stabilized. Its true state of thermodynamic equilibrium is one where the phases are not dispersed. Coalescence of the dispersion is prevented by the barrier formed by emulsifying agents in the interfacial region. Macroemulsions are generally white and opaque because the size of the dispersed phase droplets is relatively large (typically >400 nm). Usually vigorous agitation, such as high-shear mixing, is required to form a macroemulsion, because significant energy is required to break the dispersed phase down into small droplets. Although macroemulsions may be stable for a significant time (even years), they tend to spontaneously coalesce and separate over time.

"Microemulsion", as used herein, is a specific type of emulsion where the size of the dispersed phase droplets (typically <100 nm in diameter) is small compared to the wavelength of light, making the microemulsion appear clear and transparent to the eye when observed under diffuse, multidirectional light. Tyndall effect light scattering can generally be observed when a sample is illuminated by a collimated beam of light and an observer views the sample from an angle relative to the path of the light beam, such as an angle of from about 20 degrees to about 160 degrees, for example an angle of from about 45 degrees to about 135 degrees, for example an angle of about 90 degrees. Usually gentle mixing is sufficient to form a microemulsion. Microemulsions are thermodynamically stable and do not spontaneously separate.

"Microemulsion concentrate", as used herein, is a composition comprising one liquid phase and a surfactant package that, when combined with a second liquid phase immiscible with the first liquid phase, forms a microemulsion.

"Miniemulsion", as used herein, is an emulsion where the size of the dispersed phase droplets is intermediate between macroemulsions and microemulsions, large enough to visibly scatter light when a sample is observed under diffuse, multidirectional light, but not large enough to make the emulsion opaque. Miniemulsions often appear slightly hazy and blue-white to the eye.

"Oil", as used herein, is a liquid phase comprising at least one organic liquid.

"Surfactant", as used herein, is a surface-active agent. Many types of surfactants are known, such as those listed in McCutcheon's "Emulsifiers and Detergents" (Manufacturing Confectioner Publishing Company, Glen Rock, N.J., USA). Major classes of surfactants include anionic, cationic, nonionic, amphoteric and zwitterionic, polymeric, silicone, and fluorosurfactants.

"Surfactant package", as used herein, is a mixture of at least one surfactant and at least one coupling agent that, when combined with two immiscible liquid phases, stabilizes an emulsion.

"Water", as used herein, is a liquid phase that may comprise water or that may comprise a non-aqueous liquid that is immiscible with the oil phase of an emulsion composition.

TEST METHODS

A visual test for the presence of a microemulsion is conducted as follows: a broad spectrum visible light source (collimated "light beam") is used to illuminate a sample of the composition as prepared; an observer viewing the sample at an angle relative to the path of the light beam (e.g., as an angle of from about 20 degrees to about 160 degrees, an angle of from about 45 degrees to about 135 degrees, an angle of about 90 degrees) sees light scattering from the microemulsion. This light scattering phenomenon, sometimes referred to as Tyndall scattering, is characteristic of microemulsions. Regular emulsions are typically opaque while true solutions are clear and do not scatter light.

Solutions of DOSS in benzyl alcohol or in DBE® dibasic ester are analyzed by liquid chromatography using an Agilent 1100 series LC with a Zorbax SB-Aq C18 LC column (Agilent part number 880975-314 available from Agilent Technologies, Inc., Santa Clara, Calif., USA) and UV detector. The elution solvent program begins with 2 wt % acetonitrile in deionized water for 2 minutes, then ramps to 62 wt % acetonitrile in water over the next 22 minutes, all at constant flow rate of 0.85 mL/minute.

EXAMPLES

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for.

Unless indicated otherwise: parts are parts by weight (mass), temperature is in ° C., and pressure is in atmospheres. Standard temperature and pressure are defined as 25° C. and 1 atmosphere.

Sandpaper grit designation is the grit designation used by the Coated Abrasive Manufacturers Institute (CAMI), now part of the Unified Abrasives Manufacturers' Association. For example, 150 grit is about 92 microns average size of abrading particle and 220 grit is about 68 microns average size of abrading particle.

The following examples are provided to illustrate the present invention. The examples are not intended to limit the scope of the present invention and should not be so interpreted. It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also the individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±8%, or ±10%, of the numerical value(s) being modified. In addition, the phrase "about 'x' to 'y'" includes "about 'x' to about 'y'".

Example 1

In this example a benzyl alcohol containing microemulsion composition is illustrated. The following ingredients are combined and stirred until all solid is dissolved:

| Ingredient | parts by weight |
|---|---|
| Dioctyl sodium sulfosuccinate (Aerosol ® OT-100) | 2.5 |
| Neopentyl glycol | 1.3 |
| Benzyl alcohol | 6.2 |

The resulting microemulsion concentrate is clear, colorless, and free of solids. When heated to 60° C. or cooled to −10° C., the composition remains clear, colorless, and free of solids.

This microemulsion concentrate is diluted with water to form compositions with proportions of microemulsion concentrate:water of 9:1, 8:2, 7:3, 6:4, 5:5, 4:6, 3:7, 2:8, 1:9, and 2:1. In each case, gentle mixing provides a clear, colorless, solid-free microemulsion. For each microemulsion, a visual test for the presence of a microemulsion, as described elsewhere herein is conducted. Each composition remains clear and visually homogeneous indefinitely.

Comparative Example 1

In this comparative example a benzyl alcohol containing composition is illustrated by combining the following ingredients with stirring until all solid is dissolved:

| Ingredient | parts by weight |
|---|---|
| Dioctyl sodium sulfosuccinate (Aerosol ® OT-100) | 2.5 |
| Benzyl alcohol | 6.2 |

To the resulting composition 5 parts by weight of deionized water is added. Vigorous agitation provides a milky-white emulsion. Once agitation is stopped, the milky-white emulsion phase separates slowly.

This Comparative Example 1 differs from Example 1 by exclusion of neopentyl glycol. Exclusion of this ingredient illustrates the formation of an unstable emulsion rather than a microemulsion.

Comparative Example 2

In this comparative example a benzyl alcohol containing composition is illustrated by combining the following ingredients with stirring until all solid is dissolved: The following ingredients are combined and stirred until all solid is dissolved:

| Ingredient | parts by weight |
|---|---|
| Neopentyl glycol | 1.3 |
| Benzyl alcohol | 6.2 |

This composition is a clear, colorless solution. To this composition 5 parts by weight of deionized water is added. Vigorous agitation provides a dispersion of the two liquid phases. This dispersion separates very rapidly over a period of seconds once agitation is stopped.

This Comparative Example 2 differs from Example 1 by exclusion of dioctyl sodium sulfosuccinate. Exclusion of this ingredient illustrates the formation of an unstable dispersion rather than a microemulsion.

Examples 2-7

The six compositions shown in Table 1 are prepared accordingly. Each composition contains ca. 30 wt % benzyl alcohol and ca. 50 wt % water by weight, including water from the surfactant. The ingredients: sodium 2-ethylhexyl sulfate, sodium xylenesulfonate, sodium dodecyl sulfate, sodium p-toluenesulfonate, neopentyl glycol, and benzyl alcohol are available from Sigma-Aldrich Inc, Atlanta, Ga.; and used in the form received. OT-DEG (Aerosol® OT-DEG) and OT-75-PG (Aerosol® OT-75-PG) are available from Cytec Industries, Inc., Surfactants and Specialty Monomers, West Paterson, N.J.; and used in the form received.

Each composition is observed 1 hour after mixing, and again after 72 hours. In each of example 2-7, the mixture is observed to be clear and visually homogeneous by the visual test method, described elsewhere herein.

TABLE 1

| | Weight, grams | | | | | |
|---|---|---|---|---|---|---|
| Ingredient | Ex. 2 | Ex. 3 | Ex. 4 | Ex. 5 | Ex. 6 | Ex. 7 |
| Sodium 2-ethylhexyl sulfate, 50 wt % in water | 2.50 | | | | | |
| Sodium xylenesulfonate, 40 wt % in water | | 3.13 | | | | |
| Sodium dodecylsulfate (solid) | | | 1.25 | | | |
| sodium p-toluenesulfonate (solid) | | | | 1.25 | | |
| OT-DEG | | | | | 1.69 | |
| OT-75-PG | | | | | | 1.60 |
| neopentyl glycol | 0.65 | 0.65 | 0.65 | 0.65 | 0.62 | 0.62 |
| DBE ™-LVP dibasic ester | | | | | | |
| Benzyl alcohol | 3.10 | 3.10 | 3.10 | 3.10 | 2.94 | 2.98 |
| Water | 3.75 | 3.13 | 5.00 | 5.00 | 4.75 | 4.80 |
| Total weight, grams | 10 | 10 | 10 | 10 | 10 | 10 |
| Time | Visual observation of appearance | | | | | |
| 1 hour after mixing | clear | clear | clear | clear | clear | clear |
| 72 hours after mixing | clear | clear | clear | clear | clear | clear |

Example 8

In this example a benzyl alcohol containing microemulsion composition is prepared.

The phase behavior of a microemulsion prepared with a DOSS/NPG weight ratio (surfactant/coupling agent weight ratio) of ca. 2.5 is illustrated.

In order to simplify visualization and to optimize four-component mixtures, it is useful to treat two of the components as a pseudo-component of a three-component mixture. Such a treatment allows a graphical visualization on conventional three-component phase diagrams. In the case of benzyl alcohol-water microemulsions comprising benzyl alcohol, water, DOSS, and NPG, a pseudo-three-component phase diagram is constructed where the three components are benzyl alcohol, water, and "surfactant package." Here, "surfactant package" is a pseudo-component that represents a surfactant package, i.e., a mixture of DOSS and NPG with a specific, constant DOSS/NPG ratio (surfactant/coupling agent ratio).

The example illustrates the process to construct a phase diagram for DOSS/NPG weight ratio of about 2.5.

A mixture of 1.20 g DOSS, 0.48 g NPG, 1.67 g benzyl alcohol, and 1.67 g water is prepared. The weight ratio of DOSS/NPG ("surfactant package" pseudo-component) in this mixture is ca. 2.5 and the mixture is visually clear. The mixture contains equal amounts of water, surfactant package, and benzyl alcohol. This mixture provides a composition plotted at the center of the three-component phase diagram, at a point labeled I in FIG. 1.

To this mixture a small amount of benzyl alcohol is added, followed by an equal amount of water, recording the weight of each addition. Since water and benzyl alcohol are added in equal amounts, each addition moves the composition along a line bisecting the three-component phase diagram and passing through the corner representing 100% surfactant (line J-K in FIG. 1). Each addition moves the composition closer to the side of the triangle opposite the "surfactant package" corner (the point labeled K). After each addition, a visual observation is made. The mixture either remains clear, shows visible turbidity, or a visual sign of phase separation. The first indication of turbidity or phase separation marks the transition from the microemulsion regime. Generally the transition is to a regular emulsion. Accordingly a phase boundary can be located by this process.

In this process to locate a phase boundary for the composition the weight of each addition and composition of the mixture resulting after each addition is shown in Table 2. The "amounts added" represent each incremental addition, not a cumulative total, but a "weight fraction" representing a cumulative effect of the additions on the initial composition. The composition defining the phase boundary is taken as the average of the last observed clear (microemulsion) composition and the first observed turbid or milky (macroemulsion) composition. Any slight cloudiness or haziness (as shown in Table 2) indicates that the composition is very close to a phase boundary. In such a case the previous clear point and the next distinctly milky point are averaged. This point is plotted in FIG. 1 and indicated as point A.

TABLE 2

| Amount added | | | Weight fraction | | |
|---|---|---|---|---|---|
| Benzyl alcohol | Water | Observation | Surfactant | Benzyl alcohol | Water |
| 0.0000 | 0.0000 | clear | 0.3343 | 0.3328 | 0.3329 |
| 0.2502 | 0.2536 | clear | 0.3039 | 0.3477 | 0.3484 |
| 0.3001 | 0.3011 | clear | 0.2740 | 0.3626 | 0.3634 |
| 0.4058 | 0.4074 | clear | 0.2419 | 0.3786 | 0.3795 |
| 0.5016 | 0.5092 | clear | 0.2111 | 0.3936 | 0.3953 |
| 0.7549 | 0.7513 | clear | 0.1775 | 0.4107 | 0.4118 |
| 1.0007 | 1.0012 | cloudy | 0.1465 | 0.4263 | 0.4272 |
| 1.3098 | 1.3091 | milky | 0.1192 | 0.4400 | 0.4407 |

A second mixture is prepared with approximately the same DOSS/NPG mass ratio, but containing 0.89 g DOSS, 0.37 g NPG, 3.00 g benzyl alcohol, and 0.76 g water. The mixture is visually clear. Small amounts of benzyl alcohol and water are added, in the proportion of 3 parts benzyl alcohol for every 1 part of water. In this case, the initial composition is labeled as point N in FIG. 1. Each addition moves the composition of the mixture closer to the side of the triangle opposite the "surfactant package" corner, toward a mixture comprising 25 wt % water and 75 wt % benzyl alcohol; labeled as point O in FIG. 1. Visual observations are made after each addition of water and benzyl alcohol, as described above. The composition defining the phase boundary is taken as the average of the last observed clear (microemulsion) composition and the first observed turbid (macroemulsion) composition. This data is tabulated in Table 3 and the resulting composition is indicated as point B in FIG. 1.

TABLE 3

| Amount added | | | Final wt fraction | | |
|---|---|---|---|---|---|
| Benzyl alcohol | Water | Observation | Surfactant | Benzyl alcohol | Water |
| 0.0000 | 0.0000 | clear | 0.2511 | 0.5976 | 0.1512 |
| 0.5016 | 0.1758 | clear | 0.2213 | 0.6146 | 0.1641 |
| 0.6002 | 0.2092 | cloudy | 0.1938 | 0.6304 | 0.1758 |
| 0.7059 | 0.2366 | cloudy | 0.1693 | 0.6454 | 0.1853 |
| 0.8537 | 0.2806 | cloudy | 0.1469 | 0.6595 | 0.1935 |

A third mixture is prepared with approximately the same DOSS/NPG mass ratio (i.e., surfactant/coupling agent mass ratio), but this time containing 0.89 g DOSS, 0.37 g NPG, 0.76 g benzyl alcohol, and 3.04 g water. The mixture is visually clear. Small amounts of benzyl alcohol and water are added, in the proportion of 1 part benzyl alcohol for every 3 parts of water. In this case, the initial mixture is shown as point L in FIG. 1. Each subsequent addition moves the composition of the mixture closer to the side of the triangle opposite the "surfactant package" corner, toward a mixture comprising 75 wt % water and 25 wt % benzyl alcohol (point M). Visual observations are made after each addition of water and benzyl alcohol, as before and described above. The composition defining the phase boundary is taken as the average of the last observed clear (microemulsion) composition and the first observed turbid (macroemulsion) composition. Data is tabulated in Table 4 and the resulting composition plotted as point C in FIG. 1.

TABLE 4

| Amount added | | | Final wt fraction | | |
|---|---|---|---|---|---|
| Benzyl alcohol | Water | Observation | Surfactant | Benzyl alcohol | Water |
| 0.0000 | 0.0000 | clear | 0.2493 | 0.1499 | 0.6007 |
| 0.2052 | 0.6048 | clear | 0.2149 | 0.1642 | 0.6209 |
| 0.2753 | 0.8170 | clear | 0.1812 | 0.1780 | 0.6408 |
| 0.3410 | 1.0199 | clear | 0.1515 | 0.1899 | 0.6586 |
| 0.4533 | 1.3553 | clear | 0.1244 | 0.2007 | 0.6748 |
| 0.5530 | 1.6524 | clear | 0.1022 | 0.2097 | 0.6881 |
| 0.8089 | 2.4031 | hazy | 0.0811 | 0.2184 | 0.7005 |
| 1.0002 | 3.0012 | cloudy | 0.0645 | 0.2249 | 0.7107 |

In FIG. 1, the points D and E represent the solubility of water in benzyl alcohol and of benzyl alcohol in water respectively, with no surfactant present. A curve drawn through points D-B-A-C-E approximates the phase boundary between the single-phase (microemulsion) region and the two-phase (macroemulsion) region. A line drawn from point F (100% water) tangent to this curve (approximated by line F-C) and extended to the opposite side of the three component phase diagram (line F-H in FIG. 1.) gives point H. The composition indicated by point H, at about 28 wt % surfactant and 72 wt % benzyl alcohol, in this example, represents the minimum amount of surfactant needed in a water-free "microemulsion concentrate" of benzyl alcohol and surfactant, so that the concentrate can be diluted with water with little or no phase separation.

Examples 9-16

Optimization of DOSS/NPG Ratio in Benzyl Alcohol Microemulsions Examples 9 through 16 are conducted exactly as described for Example 8, except using different DOSS/NPG ratios ranging from 0 to infinite. In each case, the composition corresponding of the "microemulsion concentrate" (point H in FIG. 1) is determined graphically, by drawing line F-C and extending it to point H.

Results of examples 8 through 16 are given in Table 5.

To minimize cost and impact on the environment, it may be desirable to minimize the amount of surfactant in a formulation. Examples 8 through 16 show that total surfactant requirement decreases as DOSS/NPG mass ratio (i.e., surfactant/coupling agent mass ratio) increases, up to a ratio of about 3, and then increases slightly as ratio is increased further. In general, a minimum cost ratio of surfactant/coupling agent depends on the relative costs of the surfactant(s) and coupling agent(s).

TABLE 5

| Example | DOSS/NPG weight ratio | Composition of microemulsion concentrate: Benzyl alcohol, wt % | Surfactant Package (total of DOSS + NPG), wt % | DOSS, wt % | NPG, wt % |
|---|---|---|---|---|---|
| 9 | 0 (no DOSS) | 40 | 60 | 0.00 | 60.00 |
| 10 | 0.5 | 59 | 41 | 13.67 | 27.33 |
| 11 | 1 | 64 | 36 | 18.00 | 18.00 |
| 12 | 1.75 | 64 | 36 | 22.91 | 13.09 |
| 13 | 2 | 65 | 35 | 23.33 | 11.67 |
| 8 | 2.5 | 72 | 28 | 20.00 | 8.00 |
| 14 | 3 | 73 | 27 | 20.25 | 6.75 |
| 15 | 4 | 69 | 31 | 24.80 | 6.20 |
| 16 | infinite (no NPG) | 69 | 31 | 31.00 | 0.00 |

Examples 17-30

Examples 17 through 30 are conducted exactly as described for Example 13, except using different surfactants in place of DOSS. In all cases, the surfactant/NPG ratio is maintained at 2.0, as in Example 13. In each case, the composition corresponding of the "microemulsion concentrate" (point H in FIG. 1) is determined graphically, by drawing line F-C and extending it to point H.

Results of examples 17 through 30 are given in Table 6.

TABLE 6

| Example | Surfactant | Microemulsion concentrate, wt %: Surfactant | NPG | BA |
|---|---|---|---|---|
| 17 | Dicyclohexyl sodium sulfosuccinate | 20.0 | 10.0 | 70.0 |
| 18 | Sodium dodecylbenzene sulfonate | 22.0 | 11.0 | 67.0 |
| 19 | Sodium xylenesulfonate | 22.0 | 11.0 | 67.0 |
| 13 | Dioctyl sodium sulfosuccinate HLB 32 | 23.3 | 11.7 | 65.0 |
| 20 | Sodium dodecylsulfate HLB 40 | 28.0 | 14.0 | 58.0 |
| 21 | Sodium toluenesulfonate | 28.0 | 14.0 | 58.0 |
| 22 | Sodium stearate HLB 18 | 30.0 | 15.0 | 55.0 |
| 23 | Sodium 2-ethylhexylsulfate HLB 42 | 32.0 | 16.0 | 52.0 |
| 24 | PEG-PPG-PEG Mn 8400 HLB 24.0 | 36.0 | 18.0 | 46.0 |
| 25 | Tomadol ® 25-12 ethoxylated alcohols ethoxylated C12-C15 alcohol, 11.9 EO, HLB 14.4 | 40.0 | 20.0 | 40.0 |
| 26 | Pentaerythritol ethoxylate (15 EO/4 OH) | 40.0 | 20.0 | 40.0 |
| 27 | Synperonic ™ PE/F127 PEG-PPG-PEG MW ~12000 | 40.0 | 20.0 | 40.0 |
| 28 | Brij 35 23 EO lauryl ether HLB 16.9 | 40.7 | 20.3 | 39.0 |
| 29 | PEG-PPG-PEG Mn 1900 HLB 20.5 | 42.0 | 21.0 | 37.0 |
| 30 | Glucopon ® 625 alkyl polyglucoside surfactant | 42.0 | 21.0 | 37.0 |

Examples 31-34

Pre-Saturated Wipe for Removal of Spray-Paint Graffiti

White ceramic tiles are uniformly coated with Rust-Oleum® brand "Painter's Touch" flat black spray paint. The paint is allowed to dry thoroughly (several months at room temperature).

General Procedure:

For each cleaning test, one painted tile is positioned in a BYK-Gardner Abrasion Tester (Catalog number PB-8100, available from BYK-Gardner, USA) and the tester is pre-set for 150 cleaning cycles. Each cycle comprises one forward and one reverse cleaning stroke. A Georgia-Pacific Brawny® brand industrial wipe, product 20040, is cut to 9"×9" size and moistened with 10 g cleaning solution (tabulated in Table 7). A clean cellulose sponge (to fit snugly inside the brush holder of the BYK-Gardner Abrasion Tester) is moistened with water to expand it and make it pliant; as much excess water as possible is squeezed out, leaving the sponge moist but not excessively wet. The cleaning-solution-moistened wipe is wrapped around the sponge, placed in the brush holder, and the tester started. The tester counts each cleaning cycle and stops when the pre-set number of cycles (150) is completed. The cleaned tile is removed from the tester and cleaning performance evaluated visually.

Results of examples 31 through 34 are given in Table 7.

TABLE 7

| Example | Cleaning solution | Performance rating (visual) 1 = almost 100% removed 4 = almost no effect (0% removed) |
|---|---|---|
| 31 | 2 parts Benzyl alcohol microemulsion concentrate of Example 1 diluted with 1 part deionized water | 3 |
| 32 | Mixture of 75 wt % Example 31 with 25 wt % methyl ester from soybean oil | 4 |
| 33 | Mixture of 75 wt % Example 31 with 25 wt % INVISTA DBE-LVP | 1 |
| 34 | Mixture of 75 wt % Example 31 with 25 wt % propylene carbonate | 2 |

Examples 35-50

Examples 35 through 50 are conducted exactly as described for Example 13, except using different coupling agents in place of neopentyl glycol. In all cases, the DOSS/coupling agent weight ratio is maintained at 2.0, as in Example 13. In each case, the composition corresponding of the "microemulsion concentrate" (point H in FIG. 1) is determined graphically, by drawing line F-C and extending it to point H.

Results of examples 35 through 50 are given in Table 8.

TABLE 8

| Example | Coupling agent | Microemulsion concentrate (point H), weight fraction: DOSS | Coupling agent | Benzyl alcohol |
|---|---|---|---|---|
| 35 | MPDiol (2-methyl-1,3-propanediol) | 0.218 | 0.112 | 0.671 |
| 36 | 1,2-hexanediol | 0.415 | 0.212 | 0.373 |
| 37 | ethylene glycol | 0.416 | 0.210 | 0.374 |
| 38 | propylene glycol | 0.413 | 0.211 | 0.375 |
| 39 | glycerine | 0.239 | 0.123 | 0.639 |
| 40 | 1,2-butanediol | 0.199 | 0.101 | 0.700 |
| 41 | 1,2-pentanediol | 0.200 | 0.102 | 0.698 |
| 42 | hexylene glycol (2-methyl-2,4-pentanediol) | 0.200 | 0.102 | 0.698 |
| 43 | methanol | 0.199 | 0.100 | 0.700 |
| 44 | ethanol | 0.199 | 0.101 | 0.700 |
| 45 | n-propanol | 0.184 | 0.093 | 0.723 |

TABLE 8-continued

| Example | Coupling agent | Microemulsion concentrate (point H), weight fraction | | |
|---|---|---|---|---|
| | | DOSS | Coupling agent | Benzyl alcohol |
| 46 | isopropanol | 0.199 | 0.100 | 0.701 |
| 47 | n-butanol | 0.219 | 0.110 | 0.670 |
| 48 | n-hexanol | 0.377 | 0.191 | 0.433 |
| 49 | 50 wt % glycerol + 50 wt % NPG | 0.184 | 0.093 | 0.723 |
| 50 | NPG (neopentyl glycol) | 0.236 | 0.120 | 0.644 |

Examples 51-89

Examples 51 through 89 illustrate the use of co-solvents in compositions of the present disclosure. Each example composition is prepared by gentle mixing of 75 parts by weight of base formulation and 25 parts by weight of co-solvent. In each example two separate base formulations are used: the microemulsion concentrate of Example 1 and the 2:1 microemulsion of Example 1. The resulting compositions are evaluated visually. Results of examples 51 through 89 are given in Table 9.

TABLE 9

| Example | Co-solvent | Base Formulation | |
|---|---|---|---|
| | | Microemulsion Concentrate of Example 1 | 2:1 Microemulsion of Example 1 |
| 51 | 1,3-Propanediol | Slightly cloudy | Clear |
| 52 | 2-Butanone | Clear | Clear |
| 53 | 2-Methyl-1,3-propanediol | Clear | Clear |
| 54 | Acetic acid | Clear | Clear |
| 55 | Acetone | Clear | Clear |
| 56 | Acetonitrile | Clear | Clear |
| 57 | Aromatic 150 | Clear | Cloudy, slight phase separation |
| 58 | Butyl lactate | Clear | Cloudy |
| 59 | Cyclohexanol | Clear | Slightly cloudy |
| 60 | Cyclohexanone | Clear | Clear |
| 61 | DBE ® LVP (INVISTA) | Clear | Clear |
| 62 | Diacetin | Clear | Clear |
| 63 | Diethylene glycol | Clear | Clear |
| 64 | Diethylene glycol monobutyl ether | Clear | Clear |
| 65 | Dimethyl sulfoxide | Cloudy | Clear |
| 66 | Dipropylene glycol | Clear | Clear |
| 67 | d-Limonene | Clear | Clear |
| 68 | Ethyl 3-ethoxypropionate | Clear | Slightly cloudy |
| 69 | Ethyl lactate | Clear | Clear |
| 70 | Ethylene glycol monobutyl ether | Clear | Clear |
| 71 | Exxsol ® D 110 fluid (ExxonMobil) | Phase separation | Phase separation |
| 72 | Gamma butyrolactone | Slightly cloudy | Clear |
| 73 | Glycerol | Clear | Clear |
| 74 | Isopar ® M (ExxonMobil) | Phase separation | Phase separation |
| 75 | Isopropanol | Clear | Clear |
| 76 | Methyl acetate | Clear | Clear |
| 77 | Methyl Soyate | Clear | Clear |
| 78 | Methylene chloride | Clear | Cloudy, slight phase separation |
| 79 | Monoacetin | Clear | Clear |
| 80 | N-methyl pyrrolidinone | Cloudy | Clear |

TABLE 9-continued

| Example | Co-solvent | Base Formulation | |
|---|---|---|---|
| | | Microemulsion Concentrate of Example 1 | 2:1 Microemulsion of Example 1 |
| 81 | Propylene carbonate | Clear | Clear |
| 82 | t-Butyl acetate | Clear | Cloudy |
| 83 | Tetrahydrofuran | Clear | Clear |
| 84 | Triacetin | Clear | Clear |
| 85 | Triethanolamine | Clear | Clear |
| 86 | Triethyl citrate | Clear | Cloudy, slight phase separation |
| 87 | Triethyl phosphate | Clear | Clear |
| 88 | Tripropylene glycol methyl ether | Clear | Clear |
| 89 | Xylene | Clear | Cloudy, slight phase separation |

Example DS1

A mixture of 70 g ULTRADOSS 75 (DOSS in a mixture of water and ethanol, available from MFG Chemical, Dalton, Ga., USA) and 54.6 g benzyl alcohol is charged to a round-bottom flask equipped with stirrer, heating mantle, and vacuum-distillation head. The mixture is heated to 60° C., then pressure is reduced to 317 mm Hg absolute. Temperature is gradually increased to 90° C. and pressure is gradually reduced to 50 mm Hg absolute over 4 hours, then these conditions are maintained for 2 hours. A total of 13.8 g volatile material is condensed overhead. The DOSS solution remains in the round-bottom flask and weighs 107.6 g. It is analyzed and found to contain 47.4 wt % DOSS and 0.31 wt % water. The very low concentration of residual water indicates that virtually all water and ethanol that were present in the ULTRADOSS 75 have been removed, leaving a solution of DOSS in benzyl alcohol. Viscosity is 135 cSt at 20-25° C.

Example DS2

DOSS is prepared using methods known in the art, such as described in Process Economics Program Report 218, "Specialty Surfactants," July 1997, available from SRI Consulting, a division of Access Intelligence, LLC. Typically, maleic anhydride is esterified using 2-ethylhexanol at esterification conditions known by those skilled in the art. When esterification is sufficiently complete, the diethylhexyl maleate ester product is sulfonated by reaction with aqueous sodium bisulfite. After reaction is complete, pH is adjusted to about 6. An amount of benzyl alcohol is added slightly in excess of the amount required to produce a about 60 wt % solution of DOSS in benzyl alcohol (to allow for some benzyl alcohol loss during water removal). The mixture is heated and vacuum applied to remove water. The mixture is heated only enough to accomplish the desired water removal, in this case no hotter than about 100° C., to minimize potential for DOSS decomposition or other undesirable side reactions. The mixture is analyzed periodically for water as heat and vacuum are continually applied to remove water until the water concentration has been reduced to less than about 2 wt %. The resulting solution of DOSS in benzyl alcohol is analyzed and found to contain 60.5 wt % DOSS, 0.3 wt % water, and 38.1 wt % benzyl alcohol. Viscosity is 740 cSt at 23° C.

Example DS3

A microemulsion concentrate is prepared by combining 41.67 g of a solution of DOSS in benzyl alcohol (60.0 wt %

DOSS, prepared as in Example DS2 above), 13 g neopentyl glycol, and an additional 45.33 g benzyl alcohol. The resulting composition has the same final composition as Example 1. The resulting microemulsion concentrate is diluted with water to obtain microemulsions with water content ranging from 10 wt % water to 90 wt % water in increments of 10 wt % water; all dilutions form stable, visually clear, microemulsions.

Preparation of Test Specimens and Latex and Alkyd Paint Stripper Testing (for Examples PS1 to PS24)

General procedure for preparation of latex-coated test specimen and alkyd-coated test specimen: Well-dried pine boards, nominally 1-inch×4-inches×48-inches (nominally 2.5 cm×10.2 cm×121.9 cm) are sanded to clean, bare wood using a belt sander, then finish sanded using 150 grit sandpaper and an orbital finish sander. Sanding dust is removed by vacuum and using rags soaked with paint thinner. After the boards are completely dry, 1 coat Deft brand lacquer sanding sealer (available from DEFT, Inc., Irvine, Calif., USA) is applied and allowed to dry. The sealer coating is lightly sanded with 220 grit sandpaper, then one coat of white paint (Rust-Oleum "Painter's Touch" gloss white, #1992 latex or Rust-Oleum Protective Enamel #7792 alkyd) is applied and allowed to dry 5 days. The coating is lightly sanded with 220 grit sandpaper, then one coat of red paint (Rust-Oleum "Painter's Touch" Colonial Red #1964 latex or Rust-Oleum Protective Enamel Sunrise Red #7762 alkyd) is applied and allowed to dry 24 hours. The coating is lightly sanded with 220 grit sandpaper, then one coat of yellow paint (Rust-Oleum "Painter's Touch" Sun Yellow #1945 latex or Rust-Oleum Protective Enamel Sunburst Yellow #7747 alkyd) is applied and allowed to dry 24 hours. The coating is lightly sanded with 220 grit sandpaper, then one coat of white paint (Rust-Oleum "Painter's Touch" gloss white, #1992 latex or Rust-Oleum Protective Enamel #7792 alkyd) is applied and allowed to dry at least 4 weeks before use in paint stripper tests. Rust-Oleum paints are manufactured by Rust-Oleum Corp., Vernon Hills, Ill., USA.

General procedure for paint stripper testing: For each test, approximately 0.12 g of the test composition is applied and spread to a spot approximately 1 cm in diameter on the surface of the coated test specimen prepared as described above. After 30 minutes (for latex coatings) or 60 minutes (for alkyd coatings), the test spot is scraped, using a hard plastic spatula, carefully observing how much coating is softened and can be readily removed. Each test is visually rated as having removed no paint (0% removal), 1 layer of paint (33% removal), 2 layers of paint (67% removal) or 3 or more layers of paint (100% removal).

Example PS1

The microemulsion composition of Example 77 is tested on an alkyd-coated test specimen prepared as described above. It is found that the coating removal rating is 67% removal.

Example PS2

The microemulsion concentrate composition of Example 1 is tested on a latex-coated test specimen prepared as described above. It is found that the coating removal rating is 67% removal.

Example PS3

The microemulsion composition of Example 61 is tested on an alkyd-coated test specimen prepared as described above. It is found that the coating removal rating is 67% removal.

Example PS4

The microemulsion concentrate composition of Example 81 is tested on a alkyd-coated test specimen prepared as described above. It is found that the coating removal rating is 0% removal.

Example PS5

The microemulsion concentrate composition of Example 88 is tested on a alkyd-coated test specimen prepared as described above. It is found that the coating removal rating is 0% removal.

Example PS6

The 2:1 microemulsion composition of Example 1 is tested on an alkyd-coated test specimen prepared as described above. It is found that the coating removal rating is 100% removal.

Example PS7

The microemulsion composition of Example 88 is tested on a latex-coated test specimen prepared as described above. It is found that the coating removal rating is 33% removal.

Example PS8

The microemulsion composition of Example 66 is tested on an alkyd-coated test specimen prepared as described above. It is found that the coating removal rating is 0% removal.

Example PS9

The microemulsion concentrate composition of Example 77 is tested on an alkyd-coated test specimen prepared as described above. It is found that the coating removal rating is 33% removal.

Example PS10

The microemulsion composition of Example 61 is tested on a latex-coated test specimen prepared as described above. It is found that the coating removal rating is 67% removal.

Example PS11

The microemulsion composition of Example 81 is tested on a latex-coated test specimen prepared as described above. It is found that the coating removal rating is 100% removal.

Example PS12

The microemulsion concentrate composition of Example 77 is tested on a latex-coated test specimen prepared as described above. It is found that the coating removal rating is 67% removal.

Example PS13

The microemulsion concentrate composition of Example 88 is tested on a latex-coated test specimen prepared as described above. It is found that the coating removal rating is 33% removal.

Example PS14

The microemulsion concentrate composition of Example 66 is tested on an alkyd-coated test specimen prepared as described above. It is found that the coating removal rating is 0% removal.

Example PS15

The microemulsion concentrate composition of Example 66 is tested on a latex-coated test specimen prepared as described above. It is found that the coating removal rating is 33% removal.

Example PS16

The microemulsion concentrate composition of Example 1 is tested on an alkyd-coated test specimen prepared as described above. It is found that the coating removal rating is 67% removal.

Example PS17

The microemulsion composition of Example 66 is tested on a latex-coated test specimen prepared as described above. It is found that the coating removal rating is 33% removal.

Example PS18

The microemulsion composition of Example 88 is tested on an alkyd-coated test specimen prepared as described above. It is found that the coating removal rating is 0% removal.

Example PS19

The microemulsion composition of Example 81 is tested on an alkyd-coated test specimen prepared as described above. It is found that the coating removal rating is 0% removal.

Example PS20

The microemulsion concentrate composition of Example 61 is tested on a latex-coated test specimen prepared as described above. It is found that the coating removal rating is 33% removal.

Example PS21

The 2:1 microemulsion composition of Example 1 is tested on a latex-coated test specimen prepared as described above. It is found that the coating removal rating is 100% removal.

Example PS22

The microemulsion concentrate composition of Example 81 is tested on a latex-coated test specimen prepared as described above. It is found that the coating removal rating is 67% removal.

Example PS23

The microemulsion composition of Example 77 is tested on a latex-coated test specimen prepared as described above. It is found that the coating removal rating is 67% removal.

Example PS24

The microemulsion concentrate composition of Example 61 is tested on an alkyd-coated test specimen prepared as described above. It is found that the coating removal rating is 33% removal.

Preparation of Test Specimens and Polyurethane Paint Stripper Testing (for Examples PU1-PU12)

General procedure for preparation of polyurethane-coated test specimen: Pine boards are prepared and coated with Deft lacquer sanding sealer as described for "Preparation of test specimens for latex and alkyd paint stripper testing". The sealer coating is lightly sanded with 220 grit sandpaper. Two coats of Minwax® Polyshades® polyurethane all-in-one stain and polyurethane finish, Royal Walnut color, (manufactured by Minwax® Company, Upper Saddle River, N.J., USA) are applied, allowing the first coat to dry thoroughly and lightly sanding between coats with 220 grit sandpaper. Test specimens are allowed to dry at least 4 weeks before use in paint stripper tests.

General procedure to polyurethane paint stripper testing: For each test, approximately 0.12 g of the test composition is applied and spread to a spot approximately 1 cm in diameter on the surface of the coated test specimen prepared as described above. After 30 minutes, the test spot is scraped, using a hard plastic spatula, carefully observing how much coating is softened and can be readily removed. Each test is visually rated as having no effect (0% removal), some removal (33% removal), significant but not complete removal (67% removal) or complete removal (100% removal).

Example PU1

The 2:1 microemulsion composition of Example 1 is tested on a polyurethane-coated test specimen prepared as described above. It is found that the coating removal rating is 100% removal.

Example PU2

The microemulsion concentrate composition of Example 1 is tested on a polyurethane-coated test specimen prepared as described above. It is found that the coating removal rating is 100% removal.

Example PU3

The microemulsion concentrate composition of Example 66 is tested on a polyurethane-coated test specimen prepared as described above. It is found that the coating removal rating is 0% removal.

Example PU4

The microemulsion concentrate composition of Example 77 is tested on a polyurethane-coated test specimen prepared as described above. It is found that the coating removal rating is 0% removal.

Example PU5

The microemulsion composition of Example 77 is tested on a polyurethane-coated test specimen prepared as described above. It is found that the coating removal rating is 0% removal.

Example PU6

The microemulsion composition of Example 88 is tested on a polyurethane-coated test specimen prepared as described above. It is found that the coating removal rating is 0% removal.

Example PU7

The microemulsion composition of Example 81 is tested on a polyurethane-coated test specimen prepared as described above. It is found that the coating removal rating is 0% removal.

Example PU8

The microemulsion concentrate composition of Example 88 is tested on a polyurethane-coated test specimen prepared as described above. It is found that the coating removal rating is 0% removal.

Example PU9

The microemulsion concentrate composition of Example 61 is tested on a polyurethane-coated test specimen prepared as described above. It is found that the coating removal rating is 67% removal.

Example PU10

The microemulsion concentrate composition of Example 81 is tested on a polyurethane-coated test specimen prepared as described above. It is found that the coating removal rating is 0% removal.

Example PU11

The microemulsion composition of Example 61 is tested on a polyurethane-coated test specimen prepared as described above. It is found that the coating removal rating is 67% removal.

Example PU12

The microemulsion composition of Example 66 is tested on a polyurethane-coated test specimen prepared as described above. It is found that the coating removal rating is 0% removal.

Preparation of Test Specimens and Lithographic Printer's Ink Cleaner Testing (for Examples IS1-IS12 and Examples IW1-IW6)

General procedure for preparation of lithographic ink-coated test specimen: White ceramic tiles (United States Ceramic Tile, Bright Snow White color, item U072-44-1M, 4.25-inch×4.25-inch (10.8 cm×10.8 cm) flat tile, available from Roca Tile Group, Miami, Fla., USA) are thoroughly cleaned with detergent and water, wiped with acetone, air dried, dried 16 hours in a 60° C. oven with a slow flow of air, and then allowed to cool to room temperature. Several clean tiles are tested using a Hunter Lab ColorQuest II colorimeter (available from Hunter Associates Laboratory, Inc., Reston, Va., USA) and the average Luminance value (also referred to as L value) for clean tiles recorded as L1. One part ink (Branden Sutphin Ink Company linseed oil-based lithographic ink, Hi Gloss Dense Black, K0650VF, available from Braden Sutphin Ink Company, Cleveland, Ohio, USA) is diluted with 3 parts toluene by weight. Using an air brush, approximately 6 g of the ink-toluene solution is sprayed evenly over the glazed top surface of 8 clean ceramic tiles, allowed to air dry, dried 16 hours in a 60° C. oven with a slow flow of air, then allowed to cool to room temperature. Each individual tile is tested using a Hunter Lab ColorQuest II colorimeter to determine the L value of that soiled tile, which is recorded as L2 for that tile.

General procedure for spot tests: Each spot test is performed by applying one drop of test composition to an ink-coated specimen prepared as described above. After 20 seconds, a dry cotton swab is lightly touched to the wet area and rubbed gently to determine how much ink can be easily removed. Each result is reported as 100% (complete removal), 50% (significant, but not complete, removal), 10% (some removal), or 0% (no effect).

General procedure for testing pre-saturated wipers: For each cleaning test, one ink-coated tile specimen is positioned in a BYK-Gardner Abrasion Tester (Catalog number PB-8100, available from BYK-Gardner, Columbia, Md., USA) and the tester is pre-set for 15 cleaning cycles. Each cycle comprises one forward and one reverse cleaning stroke. A clean cellulose sponge, approximately 3.5 inch×2.75 inch×1.25 inch (approximately 8.9 cm×7.0 cm×3.2 cm), to fit snugly inside the brush holder of the BYK-Gardner Abrasion Tester, is moistened with water to expand it and make it pliant; as much excess water as possible is squeezed out, leaving the sponge moist but not excessively wet. A Georgia-Pacific Brawny® Industrial™ wiper (product #20040, available from Georgia-Pacific Consumer Products LP, Atlanta, Ga., USA) is cut to 9 inch×9 inch (22.9 cm×22.9 cm) size and moistened with 10 g test composition to obtain a pre-saturated wiper, then wrapped around the sponge, placed in the brush holder, and the tester started. The tester counts each cleaning cycle and stops when the pre-set number of cycles is completed. The cleaned tile is removed from the tester and cleaning effectiveness evaluated by using a Hunter Lab ColorQuest II colorimeter to determine the L value of the cleaned tile, which is recorded as L3 for that tile. The cleaning effectiveness, or percent cleaned, is calculated according to the formula $(L3-L2)/(L1-L2)\times 100\%$ where L1, L2, and L3 are as defined above.

Example IS1

One drop of microemulsion composition of Example 77 is applied to a lithographic ink-coated specimen prepared as described above and tested according to the spot test procedure described above. The ink is 100% removed.

Example IS2

One drop of microemulsion composition of Example 88 is applied to a lithographic ink-coated specimen prepared as described above and tested according to the spot test procedure described above. The ink is 50% removed.

Example IS3

One drop of microemulsion composition of Example 61 is applied to a lithographic ink-coated specimen prepared as described above and tested according to the spot test procedure described above. The ink is 100% removed.

Example IS4

One drop of microemulsion composition of Example 81 is applied to a lithographic ink-coated specimen prepared as described above and tested according to the spot test procedure described above. The ink is 100% removed.

Example IS5

One drop of microemulsion concentrate composition of Example 77 is applied to a lithographic ink-coated specimen prepared as described above and tested according to the spot test procedure described above. The ink is 10% removed.

Example IS6

One drop of microemulsion concentrate composition of Example 61 is applied to a lithographic ink-coated specimen prepared as described above and tested according to the spot test procedure described above. The ink is 50% removed.

Example IS7

One drop of microemulsion concentrate composition of Example 66 is applied to a lithographic ink-coated specimen prepared as described above and tested according to the spot test procedure described above. The ink is 10% removed.

Example IS8

One drop of microemulsion composition of Example 66 is applied to a lithographic ink-coated specimen prepared as described above and tested according to the spot test procedure described above. The ink is 50% removed.

Example IS9

One drop of microemulsion concentrate composition of Example 1 is applied to a lithographic ink-coated specimen prepared as described above and tested according to the spot test procedure described above. The ink is 50% removed.

Example IS10

One drop of microemulsion concentrate composition of Example 81 is applied to a lithographic ink-coated specimen prepared as described above and tested according to the spot test procedure described above. The ink is 10% removed.

Example IS11

One drop of microemulsion concentrate composition of Example 88 is applied to a lithographic ink-coated specimen prepared as described above and tested according to the spot test procedure described above. The ink is 10% removed.

Example IS12

One drop of 2:1 microemulsion composition of Example 1 is applied to a lithographic ink-coated specimen prepared as described above and tested according to the spot test procedure described above. The ink is 100% removed.

Example IW1

The 2:1 microemulsion composition of Example 1 is applied to a wiper and tested according to the pre-saturated wipers test as described above on a lithographic ink-coated specimen prepared as described above. Cleaning effectiveness is found to be 100%.

Example IW2

The microemulsion composition of Example 77 is applied to a wiper and tested according to the pre-saturated wipers test as described above on a lithographic ink-coated specimen prepared as described above. Cleaning effectiveness is found to be 17%.

Example IW3

The microemulsion composition of Example 66 is applied to a wiper and tested according to the pre-saturated wipers test as described above on a lithographic ink-coated specimen prepared as described above. Cleaning effectiveness is found to be 16%.

Example IW4

The microemulsion composition of Example 88 is applied to a wiper and tested according to the pre-saturated wipers test as described above on a lithographic ink-coated specimen prepared as described above. Cleaning effectiveness is found to be 16%.

Example IW5

The microemulsion composition of Example 61 is applied to a wiper and tested according to the pre-saturated wipers test as described above on a lithographic ink-coated specimen prepared as described above. Cleaning effectiveness is found to be 15%.

Example IW6

The microemulsion composition of Example 81 is applied to a wiper and tested according to the pre-saturated wipers test as described above on a lithographic ink-coated specimen prepared as described above. Cleaning effectiveness is found to be 20%.

Preparation of Test Specimens and Polyurethane Adhesive Removal Testing (for Examples PA1-PA6)

General procedure for preparation of polyurethane adhesive test specimen: Copper flashing, 0.005 inch (12.7 microns) thickness, is cleaned using acetone, then cut into 1 inch×1 inch (2.5 cm×2.5 cm) coupons. A small hole is punched along the edge of each coupon to allow the coupon to be suspended in the test composition for testing. Each coupon is carefully weighed to ±0.0001 g and the weight recorded as W1. Each test coupon is prepared immediately before testing as follows. Approximately 0.1 g Gorilla Glue polyurethane adhesive (manufactured by Gorilla Glue, Inc., Cincinnati, Ohio, USA) is placed on one side of the test coupon. To better control cure, 5 microliters of deionized water is added, using a 10-microliter syringe, to the adhesive on the coupon, and mixed in thoroughly. In some tests, to facilitate weight control, 0.2 g adhesive is mixed with 10 microliters water and excess discarded, leaving 0.1 g mixed adhesive behind on the coupon. The coupon and adhesive are weighed to ±0.0001 g and the weight recorded as W2. The adhesive is allowed to cure for 5 minutes at ambient temperature, then used immediately in an adhesive removal test.

General procedure for polyurethane adhesive removal testing: For each test, a soiled test specimen prepared as described above is suspended in 120 mL of the test composition contained in a 150 mL beaker, then placed in a water-filled ultrasonic bath (Branson model 2210R-MTH, 90 W, 47 kHz, manufactured by Branson Ultrasonics Corporation, Danbury, Conn., USA). Temperature of the water in the bath is controlled at 34±2° C. After 15 minutes sonication in the cleaning composition, the coupon is suspended in 120 mL deionized water, in the same ultrasonic bath, to rinse. After 5 minutes sonication in the deionized water rinse, the coupon is suspended in air to dry for 30 minutes, then weighed to ±0.0001 g. The weight is recorded as W3. The amount of soil removed, expresses as percent clean, is calculated according to the formula (W2−W3)/(W2−W1)×100%.

Example PA1

The microemulsion concentrate composition of Example 61 is tested on a polyurethane adhesive test specimen as described above. The amount of soil removed is 62%.

Example PA2

The microemulsion concentrate composition of Example 81 is tested on a polyurethane adhesive test specimen as described above. The amount of soil removed is 80%.

Example PA3

The microemulsion concentrate composition of Example 66 is tested on a polyurethane adhesive test specimen as described above. The amount of soil removed is 84%.

Example PA4

The microemulsion concentrate composition of Example 1 is tested on a polyurethane adhesive test specimen as described above. The amount of soil removed is 100%.

Example PA5

The microemulsion concentrate composition of Example 77 is tested on a polyurethane adhesive test specimen as described above. The amount of soil removed is 95%.

Example PA6

The microemulsion concentrate composition of Example 88 is tested on a polyurethane adhesive test specimen as described above. The amount of soil removed is 22%.

Preparation of Test Specimens and Permanent Black Marker Graffiti-Removal Testing (for Examples PM1-PM12)

General procedure for preparing graffiti-soiled test specimen: A white fiberglass tray, nominally 0.1 inch (2.5 mm) thick, is cut into 2 inch×2 inch (5 cm×5 cm) test specimens. Ten specimens are tested using a Hunter ColorQuest II colorimeter (available from Hunter Associates Laboratory, Inc., Reston, Va., USA) and the average Luminance value (also referred to as L value) recorded as L1. Specimens are coated using a Marks-A-Lot® permanent black marker (available from Avery Dennison, Diamond Bar, Calif., USA) until they are evenly and uniformly black, then allowed to dry in air at room temperature. The soiled specimens are again tested on the colorimeter and the L value of each individual specimen recorded as L2 for that specimen.

General procedure for graffiti-removal testing: A BYK-Gardner Abrasion Tester (Catalog number PB-8100, available from BYK-Gardner, Columbia, Md., USA) is pre-set for 2 cleaning cycles, where each cycle comprises one forward and one reverse cleaning stroke. A clean cellulose sponge, approximately 3.5 inch×2.75 inch×1.25 inch (approximately 8.9 cm×7.0 cm×3.2 cm), to fit snugly inside the brush holder of the BYK-Gardner Abrasion Tester, is moistened with water to expand it and make it pliant; as much excess water as possible is squeezed out, leaving the sponge moist but not excessively wet. A dry Kimberly-Clark WypAll™ brand all purpose wiper (available from Kimberly-Clark, Dallas, Tex., USA) is wrapped around the sponge, placed in the brush holder, and left upside-down until needed. Approximately 15 g of the cleaning composition to be tested is poured into a 2.5 inch×5 inch (6.4 cm×12.7 cm) aluminum foil pan. The graffiti-soiled test specimen is dipped into the test composition for 1 second, lifted and drained 10 seconds, immediately placed on the BYK-Gardner Abrasion Tester, and the tester started. The tester counts each cleaning cycle and stops when the pre-set number of cycles, in this case 2, is completed. The cleaned specimen is removed from the tester, dipped briefly (0.5 second) in water to rinse, then stood upright at an angle to drain and air dry. Cleaning effectiveness is evaluated by using a Hunter Lab ColorQuest II colorimeter to determine the L value of the cleaned specimen, which is recorded as L3 for that specimen. The cleaning effectiveness, or percent cleaned, is calculated according to the formula (L3−L2)/(L1−L2)×100% where L1, L2, and L3 are as defined above.

Example PM1

The microemulsion concentrate composition of Example 66 is tested on a graffiti-soiled test specimen as described above. Cleaning effectiveness is 90%.

Example PM2

The microemulsion concentrate composition of Example 77 is tested on a graffiti-soiled test specimen as described above. Cleaning effectiveness is 84%.

Example PM3

The microemulsion composition of Example 77 is tested on a graffiti-soiled test specimen as described above. Cleaning effectiveness is 95%.

Example PM4

The microemulsion composition of Example 88 is tested on a graffiti-soiled test specimen as described above. Cleaning effectiveness is 88%.

Example PM5

The 2:1 microemulsion composition of Example 1 is tested on a graffiti-soiled test specimen as described above. Cleaning effectiveness is 90%.

Example PM6

The microemulsion composition of Example 66 is tested on a graffiti-soiled test specimen as described above. Cleaning effectiveness is 100%.

Example PM7

The microemulsion concentrate composition of Example 1 is tested on a graffiti-soiled test specimen as described above. Cleaning effectiveness is 86%.

Example PM8

The microemulsion composition of Example 81 is tested on a graffiti-soiled test specimen as described above. Cleaning effectiveness is 81%.

Example PM9

The microemulsion composition of Example 61 is tested on a graffiti-soiled test specimen as described above. Cleaning effectiveness is 80%.

Example PM10

The microemulsion concentrate composition of Example 88 is tested on a graffiti-soiled test specimen as described above. Cleaning effectiveness is 71%.

Example PM11

The microemulsion concentrate composition of Example 81 is tested on a graffiti-soiled test specimen as described above. Cleaning effectiveness is 81%.

Example PM12

The microemulsion concentrate composition of Example 61 is tested on a graffiti-soiled test specimen as described above. Cleaning effectiveness is 76%.

Preparation of Test Specimens and Epoxy Adhesive Removal Testing (for Examples EA1-EA12)

General procedure for preparing a test coupon: Copper flashing, 0.005 inch (12.7 microns) thickness, is cleaned using acetone, then cut into 1 inch×1 inch (2.5 cm×2.5 cm) coupons. A small hole is punched along the edge of each coupon to allow the coupon to be suspended in the test composition for testing using the same style hanger assembly as described for grease removal (elsewhere herein). Each coupon is carefully weighed to ±0.0001 g and the weight recorded as W1.

General procedure for preparing an epoxy adhesive-coated test specimen: A test coupon is attached to a hanger assembly, weighed to ±0.0001 g, and the weight recorded as W1. Approximately 0.1 g of two-part epoxy adhesive (Loctite® 2-part marine epoxy, 50-minute cure, manufactured by Henkel Corporation, Düsseldorf, Germany) is mixed thoroughly and applied to both sides of the test coupon. The coupon, adhesive, and hanger assembly are re-weighed to ±0.0001 g and the weight recorded as W2. The adhesive is allowed to cure for 4.5 hours (270 minutes) at ambient temperature before cleaning.

General procedure for epoxy adhesive removal testing: For each test, a soiled test specimen (i.e., epoxy adhesive-coated test specimen) prepared as described above is suspended in 45 mL of the test composition contained in a 50 mL beaker, then placed in a water-filled ultrasonic bath (Branson model 2210R-MTH, 90 W, 47 kHz, manufactured by Branson Ultrasonics Corporation, Danbury, Conn., USA). Temperature of the water in the bath is controlled at 34±2° C. After 15 minutes sonication in the cleaning composition, the coupon is suspended in 45 mL deionized water in a 50 mL beaker, in the same ultrasonic bath, to rinse. After 5 minutes sonication in the deionized water rinse, the coupon is suspended in air to dry for 30 minutes, then weighed to ±0.0001 g. The weight is recorded as W3. The amount of soil removed, expresses as percent clean, is calculated according to the formula $(W2-W3)/(W2-W1)\times 100\%$ Example EA1

The microemulsion composition of Example 88 is tested on an epoxy adhesive-coated test specimen as described above. The amount of soil removed is 12%.

Example EA2

The microemulsion composition of Example 81 is tested on an epoxy adhesive-coated test specimen as described above. The amount of soil removed is 13%.

Example EA3

The microemulsion concentrate composition of Example 81 is tested on an epoxy adhesive-coated test specimen as described above. The amount of soil removed is 100%.

Example EA4

The microemulsion composition of Example 66 is tested on an epoxy adhesive-coated test specimen as described above. The amount of soil removed is 46%.

Example EA5

The microemulsion concentrate composition of Example 88 is tested on an epoxy adhesive-coated test specimen as described above. The amount of soil removed is 50%.

Example EA6

The microemulsion concentrate composition of Example 66 is tested on an epoxy adhesive-coated test specimen as described above. The amount of soil removed is 88%.

Example EA7

The microemulsion concentrate composition of Example 1 is tested on an epoxy adhesive-coated test specimen as described above. The amount of soil removed is 93%.

Example EA8

The 2:1 microemulsion composition of Example 1 is tested on an epoxy adhesive-coated test specimen as described above. The amount of soil removed is 88%.

Example EA9

The microemulsion composition of Example 77 is tested on an epoxy adhesive-coated test specimen as described above. The amount of soil removed is 38%.

Example EA10

The microemulsion composition of Example 61 is tested on an epoxy adhesive-coated test specimen as described above. The amount of soil removed is 30%.

Example EA11

The microemulsion concentrate composition of Example 61 is tested on an epoxy adhesive-coated test specimen as described above. The amount of soil removed is 74%.

Example EA12

The microemulsion concentrate composition of Example 77 is tested on an epoxy adhesive-coated test specimen as described above. The amount of soil removed is 67%.

Preparation of Test Specimens and Grease Removal Testing (for Examples WG1-WG12)

General procedure for preparing test coupon: Stainless steel test coupons are prepared, 0.032 inch (0.8 mm) thick× 0.98 inch (2.5 cm) square, with a small hole along one edge so that they can be hung from a wire to suspend them in cleaning solution. The test coupons are cleaned thoroughly with toluene and allowed to air dry.

General procedure for preparing a hanger assembly: A hanger assembly is prepared comprising a steel wire hook and a circular disk. The circular disk is of a size large enough to cover the top of a 50 mL test beaker and serve as a lid. The steel wire hook is attached to the center of the circular disk and sized and shaped to securely hang a test coupon so that when the circular disk is resting on the rim of the beaker (acting as a lid for the beaker), the test coupon is completely immersed in 45 mL of test liquid in the 50 mL beaker, but not touching the bottom of the beaker.

General procedure for preparing a grease-soiled test specimen: For each test, a test coupon is hung from the wire of a hanger assembly. The coupon with hanger assembly is weighed carefully and the clean weight recorded as W1. The coupon is evenly coated with approximately 0.1 g Castrol® multi-purpose wheel bearing grease (available from BP Lubricants USA, Inc., Wayne, N.J., USA) and weighed again, the soiled pre-test weight being recorded as W2.

General procedure for soil (grease) removal testing: For each test, a 50 mL beaker is charged with 45 mL of the test composition and placed inside a water-filled ultrasonic bath (Branson model 2210R-MTH, 90 W, 47 kHz, manufactured by Branson Ultrasonics Corporation, Danbury, Conn., USA). Another 50 mL beaker containing 45 mL deionized water is placed inside the same bath. Temperature of the water in the bath is controlled at 35±3° C. The grease-soiled test specimen is placed in the beaker of test composition so that the coupon is immersed and the circular disk of the hanger is resting on top of the beaker acting as a lid. During the test, visual observations are made to determine how quickly grease is removed and the time duration when the test coupon is visually clean is noted and recorded as T1 for that coupon. If the test coupon is not visually clean after 15 minutes, then T1 is recorded as 15 minutes. After 15 minutes sonication in the cleaning composition, regardless of whether the coupon is visually clean, the coupon is moved to the beaker containing deionized water to rinse. After 5 minutes sonication in the deionized water rinse, the coupon with hanger is suspended in air to dry for 30 minutes and then weighed to ±0.0001 g. This final weight is recorded as W3. The percent clean is calculated according to the formula $(W2-W3)/(W2-W1)\times 100\%$. The best cleaning compositions clean the grease from the test coupon in 9 minutes by visual observation, so a time factor is calculated according to the formula 9/T1. Overall cleaning effectiveness is calculated as the arithmetic product of percent clean and time factor.

Example WG1

The 2:1 microemulsion composition of Example 1 is tested on a grease-soiled test specimen according to the procedure described above. Overall cleaning effectiveness is 50%.

Example WG2

The microemulsion concentrate composition of Example 81 is tested on a grease-soiled test specimen according to the procedure described above. Overall cleaning effectiveness is 42%.

Example WG3

The microemulsion concentrate composition of Example 61 is tested on a grease-soiled test specimen according to the procedure described above. Overall cleaning effectiveness is 58%.

Example WG4

The microemulsion composition of Example 77 is tested on a grease-soiled test specimen according to the procedure described above. Overall cleaning effectiveness is 97%.

Example WG5

The microemulsion composition of Example 61 is tested on a grease-soiled test specimen according to the procedure described above. Overall cleaning effectiveness is 11%.

Example WG6

The microemulsion concentrate composition of Example 1 is tested on a grease-soiled test specimen according to the procedure described above. Overall cleaning effectiveness is 55%.

Example WG7

The microemulsion composition of Example 66 is tested on a grease-soiled test specimen according to the procedure described above. Overall cleaning effectiveness is 30%.

Example WG8

The microemulsion concentrate composition of Example 77 is tested on a grease-soiled test specimen according to the procedure described above. Overall cleaning effectiveness is 88%.

Example WG9

The microemulsion concentrate composition of Example 88 is tested on a grease-soiled test specimen according to the procedure described above. Overall cleaning effectiveness is 53%.

Example WG10

The microemulsion concentrate composition of Example 66 is tested on a grease-soiled test specimen according to the procedure described above. Overall cleaning effectiveness is 45%.

Example WG11

The microemulsion composition of Example 81 is tested on a grease-soiled test specimen according to the procedure described above. Overall cleaning effectiveness is 28%.

Example WG12

The microemulsion composition of Example 88 is tested on a grease-soiled test specimen according to the procedure described above. Overall cleaning effectiveness is 6%.

Preparation of Test Specimens and Rosin Flux on Copper (Unbaked) Removal Testing (for Examples FN1-FN12)

The procedures (preparing test coupon, preparing hanger assembly, preparing soiled test specimen, and soil removal testing) described herein for grease are used, except rosin paste flux (Radio Shack item #64-022, available from Radio Shack Corporation, Fort Worth, Tex., USA) is used in place of grease. Percent clean is calculated according to the formula (W2−W3)/(W2−W1)×100%. The most effective cleaning compositions clean the test coupon in 4 minutes by visual observation while other compositions require the full 15 minutes or more, so a time factor is calculated according to the formula 4/T1. Overall cleaning effectiveness for a test is calculated as the arithmetic product of percent clean and the time factor for the test.

Example FN1

The microemulsion concentrate composition of Example 88 is tested on an unbaked rosin flux-coated test specimen according to the procedure described above. Overall cleaning effectiveness is 49%.

Example FN2

The microemulsion composition of Example 88 is tested on an unbaked rosin flux-coated test specimen according to the procedure described above. Overall cleaning effectiveness is 56%.

Example FN3

The microemulsion concentrate composition of Example 1 is tested on an unbaked rosin flux-coated test specimen according to the procedure described above. Overall cleaning effectiveness is 66%.

Example FN4

The microemulsion concentrate composition of Example 66 is tested on an unbaked rosin flux-coated test specimen according to the procedure described above. Overall cleaning effectiveness is 50%.

Example FN5

The 2:1 microemulsion composition of Example 1 is tested on an unbaked rosin flux-coated test specimen according to the procedure described above. Overall cleaning effectiveness is 90%.

Example FN6

The microemulsion composition of Example 61 is tested on an unbaked rosin flux-coated test specimen according to the procedure described above. Overall cleaning effectiveness is 78%.

Example FN7

The microemulsion composition of Example 77 is tested on an unbaked rosin flux-coated test specimen according to the procedure described above. Overall cleaning effectiveness is 44%.

Example FN8

The microemulsion concentrate composition of Example 61 is tested on an unbaked rosin flux-coated test specimen according to the procedure described above. Overall cleaning effectiveness is 56%.

Example FN9

The microemulsion concentrate composition of Example 77 is tested on an unbaked rosin flux-coated test specimen according to the procedure described above. Overall cleaning effectiveness is 25%.

Example FN10

The microemulsion composition of Example 66 is tested on an unbaked rosin flux-coated test specimen according to the procedure described above. Overall cleaning effectiveness is 75%.

Example FN11

The microemulsion concentrate composition of Example 81 is tested on an unbaked rosin flux-coated test specimen according to the procedure described above. Overall cleaning effectiveness is 56%.

Example FN12

The microemulsion composition of Example 81 is tested on an unbaked rosin flux-coated test specimen according to the procedure described above. Overall cleaning effectiveness is 99%.

Preparation of Test Specimens and Rosin Flux on Copper (Baked) Removal Testing (for Examples FB1-FB12)

General procedure for preparing test coupon: Copper flashing, 0.005 inch (12.7 microns) thickness, is cleaned using acetone, then cut into 1 inch×1 inch (2.5 cm×2.5 cm) coupons. A small hole is punched along the edge of each coupon to allow the coupon to be suspended in the test composition for testing using the same style hanger assembly as described for grease removal (elsewhere herein). Each coupon is cleaned on both sides using toluene and a cotton swab, air dried, carefully weighed to ±0.0001 g, and the weight recorded as W1.

General procedure for preparing baked-on rosin flux-soiled test specimen: A toaster oven (Oster® toaster oven model 6260, 1500 W, available from Sunbeam Products, Inc., a subsidiary of Jarden Corporation) containing a 4.25-inch by 4.25-inch (10.8 cm by 10.8 cm) ceramic tile is pre-heated to 450° F. Both sides of each test specimen are coated with rosin paste flux (0.38 g total, Radio Shack item #64-022, available from Radio Shack Corporation, Fort Worth, Tex., USA). Test specimens are placed flat on a room-temperature ceramic tile, up to 16 specimens per tile. The ceramic tile with test specimens is placed in the toaster oven on top of the pre-heated tile, baked for 3 minutes, then removed and allowed to cool. The specimens are turned over and placed on another room-temperature ceramic tile. This tile and specimens is then placed in the toaster oven on top of the pre-heated tile, baked for 3 minutes, removed, and allowed to cool. Each soiled specimen is then re-weighed and its weight recorded as W2 for that specimen. The amount of soil (baked-on flux) is W2-W1, and is generally approximately 0.055 g.

General procedure for soil (baked-on flux) removal testing: For each test, a 50 mL beaker is charged with approximately 45 mL of the test composition and a 0.25-inch×0.5-inch (6.4 mm×12.7 mm) PTFE-coated magnetic stirbar, is placed on a magnetic stirring motor, and the stirring rate adjusted to 1500 rpm. Another 50 mL beaker is charged with 45 mL deionized water and another magnetic stirbar. The soiled test specimen is attached to a hanger assembly (as described for grease removal testing, elsewhere herein) and is placed in the beaker of test composition so that the test specimen is immersed and the circular disk of the hanger is resting on top of the beaker acting as a lid. After 5 minutes in the stirred cleaning composition, the test specimen is moved to the beaker containing deionized water to rinse. After 5 minutes in the stirred (1500 rpm) deionized water rinse, the test specimen with hanger is suspended in air to dry for 30 minutes. The cleaned test specimen is weighed to ±0.0001 g and its final weight recorded as W3. The percent clean is calculated according to the formula (W2−W3)/(W2−W1)×100%.

Example FB1

The 2:1 microemulsion composition of Example 1 is tested on a baked rosin flux-coated test specimen according to the procedure described above. The percent clean is calculated to be 64%.

Example FB2

The microemulsion composition of Example 88 is tested on a baked rosin flux-coated test specimen according to the procedure described above. The percent clean is calculated to be 65%.

Example FB3

The microemulsion concentrate composition of Example 88 is tested on a baked rosin flux-coated test specimen according to the procedure described above. The percent clean is calculated to be 62%.

Example FB4

The microemulsion concentrate composition of Example 66 is tested on a baked rosin flux-coated test specimen according to the procedure described above. The percent clean is calculated to be 29%.

Example FB5

The microemulsion concentrate composition of Example 77 is tested on a baked rosin flux-coated test specimen according to the procedure described above. The percent clean is calculated to be 64%.

Example FB6

The microemulsion concentrate composition of Example 1 is tested on a baked rosin flux-coated test specimen according to the procedure described above. The percent clean is calculated to be 47%.

Example FB7

The microemulsion composition of Example 66 is tested on a baked rosin flux-coated test specimen according to the procedure described above. The percent clean is calculated to be 52%.

Example FB8

The microemulsion concentrate composition of Example 81 is tested on a baked rosin flux-coated test specimen according to the procedure described above. The percent clean is calculated to be 68%.

Example FB9

The microemulsion concentrate composition of Example 61 is tested on a baked rosin flux-coated test specimen according to the procedure described above. The percent clean is calculated to be 67%.

Example FB10

The microemulsion composition of Example 77 is tested on a baked rosin flux-coated test specimen according to the procedure described above. The percent clean is calculated to be 68%.

Example FB11

The microemulsion composition of Example 81 is tested on a baked rosin flux-coated test specimen according to the procedure described above. The percent clean is calculated to be 72%.

Example FB12

The microemulsion composition of Example 61 is tested on a baked rosin flux-coated test specimen according to the procedure described above. The percent clean is calculated to be 58%.

Preparation of Test Specimens and Bathroom Soil on Ceramic Tile Removal Testing (for Examples BS1-BS6)

General procedure for preparing reconstituted soil: A hard water stock solution is prepared by dissolving 48 g of calcium chloride dihydrate and 12 g magnesium chloride hexahydrate in 3000 g deionized water. The resulting solution contains 12,862 ppm hardness (expressed as calcium carbonate) with a Ca:Mg molar ratio of 5.53:1.

General procedure for preparing parent soil mixture: Potting soil is milled overnight in a roller mill with ceramic tumblers. Artificial sebum is prepared according to ASTM D5343, "Standard Guide for Evaluating Cleaning Performance of Ceramic Tile Cleaners" (available from ASTM International, West Conshohocken, Pa., USA, www.astm.org), except that hexadecyl palmitate is substituted for sperm oil, which is no longer commercially available. A parent soil mixture is prepared by shaving 46.8 g IVORY® bar soap (available from Procter & Gamble, Cincinnati, Ohio, USA) into a beaker and then adding 4.2 g alkyl ethoxylate-containing shampoo, 0.72 g milled potting soil, 1.8 g artificial sebum, and 1146.48 g hard water stock solution. The mixture is warmed to 45-50° C. and mixed in a blender approximately 1 minute to obtain a smooth suspension and then filtered using a Buchner funnel and Whatman No. 1 filter paper. The filter cake is re-suspended in 1146 g deionized water, blended to obtain a smooth suspension, and refiltered. The filter cake is dried at 45° C. overnight and then pulverized.

General procedure for preparing reconstituted soil: Reconstituted soil is prepared by mixing 54 g parent soil mixture, 108 g hard water stock solution, 9.24 g hydrochloric acid, 1 g lampblack, and 1029 g isopropanol. The mixture is homogenized using a Brinkmann rotor-stator homogenizer (available from Metrohm USA, Inc., Riverview, Fla., USA) mounted in a Waring blender (available from Waring Products, Inc., Torrington, Conn., USA).

General procedure for preparing bathroom-soiled test specimens: Ceramic tiles, 4.25-inch×4.25-inch (10.8 cm×10.8 cm), (United States Ceramic Tile Company, Bright Snow White color, item UO72-44, flat tile, available from Roca Tile Group, Miami, Fla., USA) are washed with detergent and water, rinsed well, wiped with acetone, and dried. At least 5 clean tiles are tested using a Hunter LAB ColorQuest II colorimeter (available from Hunter Associates Laboratory, Inc., Reston, Va., USA) in RSEX mode (specular reflectance excluded) to determine the average whiteness index (CIE WI) value for clean tiles, which is recorded as WI1. Using an airbrush, 64 g of reconstituted soil is sprayed evenly over the surfaces of eight tiles. The tiles are allowed to air dry for at least 30 minutes, then baked in a toaster oven (Oster® toaster oven model 6260, 1500 W, available from Sunbeam Products, Inc., a subsidiary of Jarden Corporation) for 3 minutes at the highest temperature setting (>450° F.). Each soiled tile is tested using the colorimeter to determine its soiled WI value, which is recorded as WI2 for that individual tile.

General procedure for bathroom soil removal testing: For each cleaning test, one soiled tile is positioned in a BYK-Gardner Abrasion Tester (Catalog number PB-8100, available from BYK-Gardner, Columbia, Md., USA) and the tester is pre-set for 17 cleaning cycles. Each cycle comprises one forward and one reverse cleaning stroke. A clean cellulose sponge, approximately 3.5 inch×2.75 inch×1.25 inch (approximately 8.9 cm×7.0 cm×3.2 cm) to fit snugly inside the brush holder of the BYK-Gardner Abrasion Tester, is triple rinsed with tap water, saturated with hard water stock solution, and then squeezed by hand to remove as much excess water as possible. Seven milliliters of test composition is distributed evenly over the cleaning surface of the sponge, the sponge is placed in the sponge holder of the BYK-Gardner Abrasion Tester, lowered onto the surface of the soiled tile, and the tester immediately started. The tester counts each cleaning cycle and stops when the pre-set number of cycles is completed. The cleaned tile is removed from the tester and rinsed in a pan of tap water by dipping and withdrawing three times, to remove residual cleaning composition and loose soil but not to remove soil not already loosened by the cleaning test. The tile is set aside at an angle to drain and dry, then cleaning effectiveness is evaluated by using a Hunter Lab ColorQuest II colorimeter to determine the WI value of the cleaned tile, which is recorded as WI3 for that tile. The cleaning effectiveness, or percent cleaned, is calculated according to the formula (WI3-WI2)/(WI1−WI2)×100% where WI1, WI2, and WI3 are as defined above.

Example BS1

The microemulsion composition of Example 66 is tested on a bathroom-soiled test specimen as described above. Cleaning effectiveness is found to be 62%.

Example BS2

The microemulsion composition of Example 77 is tested on a bathroom-soiled test specimen as described above. Cleaning effectiveness is found to be 89%.

Example BS3

The 2:1 microemulsion composition of Example 1 is tested on a bathroom-soiled test specimen as described above. Cleaning effectiveness is found to be 98%.

Example BS4

The microemulsion composition of Example 81 is tested on a bathroom-soiled test specimen as described above. Cleaning effectiveness is found to be 31%.

Example BS5

The microemulsion composition of Example 88 is tested on a bathroom-soiled test specimen as described above. Cleaning effectiveness is found to be 72%.

Example BS6

The microemulsion composition of Example 61 is tested on a bathroom-soiled test specimen as described above. Cleaning effectiveness is found to be 65%.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method for selecting component concentrations for a microemulsion based upon identification of the phase behavior of a plurality of components comprising the microemulsion, the method comprising:

i) constructing a three-component phase diagram by ii) preparing a mixture having an initial composition according to the steps of;

iii) providing a first component comprising benzyl alcohol, iv) providing a second component comprising water, and v) providing a third component comprising an anionic surfactant and a coupling agent selected from propylene glycol, dipropylene glycol, neopentyl glycol, diethylene glycol, 2-methyl-1,3-propanediol, 1,2-butanediol, 1,2-pentanediol, 1,2-hexanediol, glycerine, and mixtures thereof, and wherein first, second and third components are present in equal amounts by weight in the mixture;

vi) representing the initial composition of the mixture at a center point of the three-component diagram wherein the vertices of the three component diagram represent pure first component, pure second component and pure third component, and vii) adding incrementally to this mixture a quantity of the first component and a quantity of the second component in equal amount by weight fraction, and wherein each addition of the incremental quantity of the first component and the second component varies the composition of the mixture along a line bisecting the three-component phase diagram toward a side opposite to and passing through a vertex of the three-component phase diagram representing pure surfactant and coupling agent;

viii) observing after each incremental addition of first and second components, an indication of turbidity in the mixture and ix) noting the weight fraction of first and second components in the composition corresponding to an initial indication of turbidity, the initial indication of turbidity marking a transition of the mixture from a microemulsion to two-phase separation; and x) preparing a second mixture having a second initial composition according to the steps of;

xi) providing a first component comprising benzyl alcohol, xii) providing a second component comprising water, and xiii) providing a third component comprising an anionic surfactant and a coupling agent selected from propylene glycol, dipropylene glycol, neopentyl glycol, diethylene glycol, 2-methyl-1,3-propanediol, 1,2-butanediol, 1,2-pentanediol, 1,2-hexanediol, glycerine, and mixtures thereof, and wherein the first, second and third components are present in known weight fractions, the known weight fractions being different from the weight fractions of the first mixture from steps i through ix;

xiv) adding incrementally to the second mixture a quantity of the first component and a quantity of the second component in a fixed ratio of weight fractions, and wherein each addition of an incremental quantity of the first component and the second component advances the composition along a fixed ratio composition line of the three-component phase diagram toward a side opposite to the vertex of the three-component phase diagram representing pure surfactant and coupling agent;

xv) observing after each addition of first and second components, an indication of turbidity in the mixture and xvi) noting the amount of first and second components corresponding to an initial indication of turbidity, the initial indication of turbidity marking a transition of the mixture from a microemulsion to two-phase separation; and xvii) repeating Step x by preparing at least a third mixture having a third initial composition and xviii) repeating steps xi and through xvi, and optionally, xix) iterating steps x through xvi, and xx) identifying a locus of points for compositions on the three-component phase diagram which mark a transition of the mixture composition from a microemulsion region to a two-phase region.

2. A method for providing a microemulsion composition comprising a first component comprising benzyl alcohol, a second component comprising water, and a third component comprising an anionic surfactant and a coupling agent selected from propylene glycol, dipropylene glycol, neopentyl glycol, diethylene glycol, 2-methyl-1,3-propanediol, 1,2-butanediol, 1,2-pentanediol, 1,2-hexanediol, glycerine, and mixtures thereof, and wherein the first, second and third components are selected in an amount by weight from the single-phase region identified from the three-component phase diagram of claim 1.

3. A method for providing a microemulsion concentrate composition according to the method of claim 2 for preparing a microemulsion, comprising, identifying a first component comprising benzyl alcohol and a second component comprising an anionic surfactant and a coupling agent selected from propylene glycol, dipropylene glycol, neopentyl glycol, diethylene glycol, 2-methyl-1,3-propanediol, 1,2-butanediol, 1,2-pentanediol, 1,2-hexanediol, glycerine, and mixtures thereof, selected in an amount by weight from the single-phase region identified from the three-component phase diagram of claim 1.

4. A method for preparing a microemulsion by diluting a microemulsion concentrate of claim 3 with a second liquid phase that is immiscible with a first liquid phase.

5. The method of claim 1 wherein the third component further comprises a coupling agent.

6. The method of claim 5 wherein the anionic surfactant selected from the group consisting of one or more sulfonates, sulfates, ethoxylated sulfates, sulfosuccinates, and combinations thereof.

* * * * *